US007639963B2

(12) United States Patent
Matsuo

(10) Patent No.: US 7,639,963 B2
(45) Date of Patent: Dec. 29, 2009

(54) IMAGE FORMING APPARATUS AND METHOD WITH CHARGE SWITCHING TO EFFECT POWER SUPPLY CONTROL

(75) Inventor: Shimpei Matsuo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 11/857,003

(22) Filed: Sep. 18, 2007

(65) Prior Publication Data

US 2008/0075494 A1 Mar. 27, 2008

(30) Foreign Application Priority Data

Sep. 26, 2006 (JP) ..... 2006-261413

(51) Int. Cl.
*G03G 15/00* (2006.01)

(52) U.S. Cl. ..... 399/88

(58) Field of Classification Search ..... 399/88, 399/320

See application file for complete search history.

(56) References Cited

U.S. PATENT DOCUMENTS 6,542,705 B2 4/2003 Fujita et al.

2005/0220474 A1* 10/2005 Sato et al. ..... 399/69

FOREIGN PATENT DOCUMENTS

JP 7-41023 9/1995
JP 2002-174988 6/2002

* cited by examiner

*Primary Examiner*—Quana M Grainger
(74) *Attorney, Agent, or Firm*—Fitzpatrick, Cella, Harper & Scinto

(57) ABSTRACT

An image forming apparatus having a thermal fixing unit reduces a current inputted from a commercial power source using electric power charged in the capacitive when warming up the thermal fixing unit. The apparatus comprises a first charging unit to charge the capacitive unit at a first charging rate, and a second charging unit to charge the capacitive unit at a second charging rate lower than the first charging rate and greater than a natural power discharge rate of the capacitive unit. A charge switching control unit switches a power source charging the capacitive unit from the first charging unit to the second charging unit when the image forming apparatus transitions into an energy saving standby mode, and returns the power source charging the capacitive unit from the second charging unit to the first charging unit when the image forming apparatus returns from the energy saving standby mode.

11 Claims, 17 Drawing Sheets

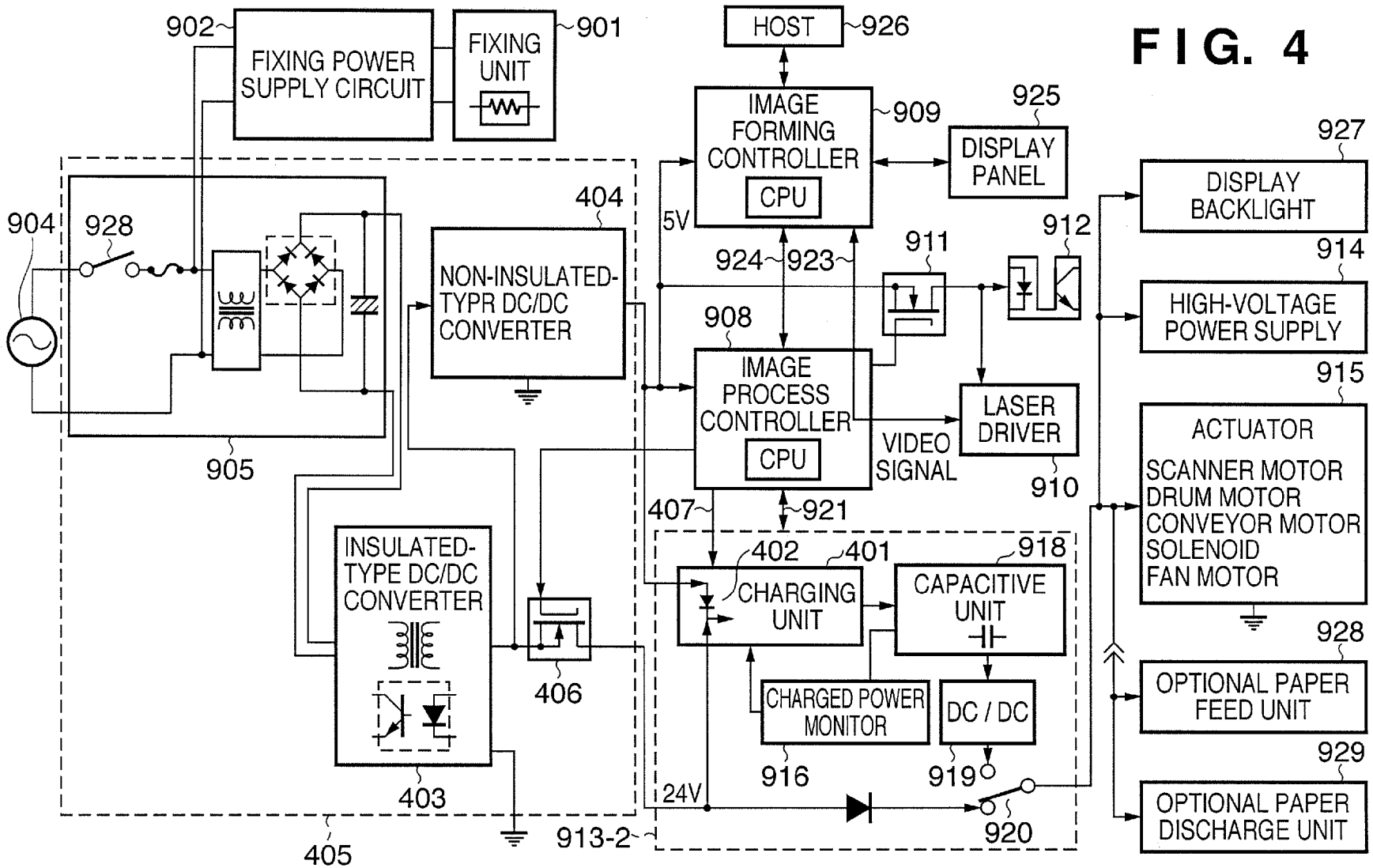
FIG. 4
927
DISPLAY BACKLIGHT
914
HIGH-VOLTAGE POWER SUPPLY
915
ACTUATOR
SCANNER MOTOR
DRUM MOTOR
CONVEYOR MOTOR
SOLENOID
FAN MOTOR
928
OPTIONAL PAPER FEED UNIT
929
OPTIONAL PAPER DISCHARGE UNIT
925
DISPLAY PANEL
912
LASER DRIVER
910
VIDEO SIGNAL
911
909
926
HOST
IMAGE FORMING CONTROLLER
CPU
923
924
908
IMAGE PROCESS CONTROLLER
CPU
921
5V
407
918
CAPACITIVE UNIT
DC / DC
919
920
401
402
CHARGING UNIT
CHARGED POWER MONITOR
916
24V
913-2
901
FIXING UNIT
404
NON-INSULATED-TYPR DC/DC CONVERTER
406
INSULATED-TYPE DC/DC CONVERTER
403
405
FIXING POWER SUPPLY CIRCUIT
902
905
928
904

IMAGE FORMING APPARATUS AND METHOD WITH CHARGE SWITCHING TO EFFECT POWER SUPPLY CONTROL

BACKGROUND OF THE INVENTION

1. Field of the Invention

The present invention relates to an image forming apparatus and a method of controlling a power supply thereof. The image forming apparatus comprises a power storage unit that receives and stores electric power from an external power source such as a commercial power source, and a thermal fixing unit using electrothermally generated temperature. The image forming apparatus reduces usage of electric current from the commercial power source using electric power from both the commercial power source and the power storage unit when the thermal fixing unit is being warmed up. The image forming apparatus, in particular, has an energy saving standby mode, and the present invention relates to energy saving of power storage in the energy saving standby mode.

2. Description of the Related Art

An image forming apparatus is conventionally known, that forms a toner image on a recording medium using an electrophotographic process and comprises a fixing unit which feeds the medium with the image and presses it between temperature-controlled fixing parts, thus thermally fixing the image thereupon. A method has been proposed in the image forming apparatus, in which rising time of the fixing unit, and thus time until start of printing, is shortened by supplying an increased quantity of electric power to the fixing unit. For example, a power storage unit in the image forming apparatus is installed, and electric power from both a commercial power source and the power storage unit is used when powering up the fixing unit, according to the cited reference 1 (JPA 2002-174988).

Another proposal is to use excess electric power from the commercial power source to power up the fixing unit, by using electric power charged in the power storage unit during standby mode to drive a direct current motor when the image forming apparatus is making a copy, according to the cited reference 2 (JPU H07-41023).

Another method has been proposed, in which the power storage unit is combined with an inductively heated thermal fixing unit capable of adjusting the electric power inputted into the device from the commercial power source, and then the electric power inputted into the fixing unit is increased according to the degree of excess electric power from the commercial power source.

An on demand fixing unit including a heater such as the inductive heater or the ceramic heater, may achieve a faster start up of the image forming apparatus by supplementing the electric power supply because of a rapid rise in temperature in response to the electric power inputted thereto. Such an approach allows doing away with pre-warming the fixing unit while leaving the image forming apparatus in a ready mode, i.e., a mode in which the apparatus turns ready to receive printing within a predetermined time period. It is possible, in turn, to adopt an on demand fixing control method that avoids a loss of electric power resulting from maintaining a standby temperature therewith.

Aside from the on demand fixing control method in ready mode, power saving control such as the following examples is performed in the image forming apparatus in order to reduce standby power. The apparatus informs to a host that ready status is in the negative and then turns into the standby mode, when a set amount of time required before turning into an energy saving mode has been elapsed after stopping print operation. A backlight in a display panel and a power supply for running the display are switched off. A power supply to an optional unit is switched off. A power supply for control of such aspects as lighting of a photo interrupter is switched off. An actuator power supply is turned off for such purposes as switching off an idle state current of a DC motor. A power supply to a cooling fan is turned off. An operation of a switching power supply is suspended. Clock cycles of a controller logic circuit are decreased. Thus, controls in the energy saving standby mode are performed, which achieve energy saving controls in standby mode.

It is possible for a user to change the set amount of time required before turning into an energy saving mode, aside from an initial time value that has been determined by taking energy saving standards into consideration. It would also be possible that the amount of time required before turning into an energy saving mode is zero seconds, such that the image forming apparatus would enter energy saving standby mode immediately upon completing a print job.

Following is a description, with reference to the attached drawings, of a prior art of an image forming apparatus comprising a configuration that uses electric power from both the commercial power source and the power storage unit when powering up the fixing unit, and also having a energy saving standby mode.

FIG. 12 is a conceptual diagram that describes a hardware configuration of a power supply control as pertains to a conventional image forming apparatus.

Reference numeral 901 is a fixing unit, which is inductively heated when an AC power supply 904 supplies high-frequency electric power via a fixing power supply circuit 902, and is controlled to maintain a predetermined temperature by an image process controller 908. Reference numeral 903 is a two-converter low-voltage power supply, which receives electric power from the AC power supply 904 that is converted into primary DC voltage by a rectification circuit 905, and outputs a 5-volt DC power supply for control and a 24-volt DC power supply for an actuator via separate insulated-type DC/DC converters 906 and 907, respectively.

Reference numeral 908 is the image process controller, which communicates with an image forming controller 909, which is connected to a host 926, via a command signal 924. The image process controller 908 synchronizes a laser driver 910, which serves as an image forming material, a high-voltage power supply 914, and an actuator 915, which comprises such components as a scanner motor, a drum motor, a conveyor motor, and a solenoid fan motor, with a video signal 923, via a well-known electrophotographic process. The synchronization draws on information of a sensor type 912. A toner image is formed on a recording medium, and the image is pressed and fixed by the temperature controlled fixing unit 901. Reference numeral 927 is a backlight that illuminates a display panel 925.

Reference numeral 911 is a power saving switch, and reference numeral 922 is a signal to suspend the converter. If the image forming apparatus is not accessed via either the host 926 or the display panel 925 within a set period of time, the image forming controller 909 generates an energy saving command. Upon receipt of the energy saving command, the image process controller 908 performs power saving through interruptions and suspensions, and transitions to energy saving standby mode, with the ready signal in the negative.

Reference numeral 913 is a power storage unit, which is inserted in a supply route of the 24-volt output from the two-converter low-voltage power. In the power storage unit 913, a charging unit 917, for which the 24-volt power is provided, supplies a constant current to charge a capacitive unit 918, which is constituted of an electric double layer capacitor. The capacitive unit 918 is charged until a predetermined level of charged power is reached under control of a charged power monitoring unit 916. A power storage unit control signal 921, issued by the image process controller 908, stops the charging of the capacitive unit 918 and activates a DC/DC converter 919. A discharge switch 920 switches the power supplied to various loads for image forming from the 24-volt output from the two-converter low-voltage power to a 24-volt output boosted from an output of the capacitive unit 918 by the DC/DC converter 919. The electric power that is charged in the capacitive unit 918 is supplied as low-voltage power in place of the 24-volt output from the two-converter low-voltage power. Therefore, the AC power for the low-voltage power supply is allocated to the AC power for the power supply of the fixing unit.

The capacitive unit 918 must be charged to the necessary level of power in time for initiation of the next warm-up. Therefore, the charging rate is set to about 30 watts, which is on the order of 10% of the typical discharge rate, taking into account intermittent printing by a cold start.

FIG. 13 is a conceptual diagram that describes a hardware configuration of a charging component of the power storage unit 913.

Reference numeral 1001 is the charging component, and incorporates the charging unit 917, the capacitive unit 918, and the charged power monitoring unit 916, from FIG. 12. Reference numeral 1002 corresponds to the capacitive unit, which is configured of a capacitive unit with a fully charged voltage of five volts that makes two serial connections to the electric double layer capacitor. Conventionally, the capacitive unit is known as a secondary battery that uses an electrochemical reaction, from the standpoint of electric storage capacity, and as a capacitor, from the standpoint of number of charge and discharge cycles. According to the present application, however, it is necessary to satisfy both types of performance, and thus, the electric double layer capacitor is selected, with a capacity of several dozen farads, which is tremendously larger than even an electrolytic capacitor.

Whichever method is selected, the capacitive unit achieves power storage by charging as a charging characteristic until the predetermined voltage is reached, and thus, may configure a charge circuit of a given voltage with a power supply of a predetermined voltage, per Thevenin's theorem. A power supply per Thevenin's theorem is inefficient, however, because it is slow to charge. Thus, a typical charging unit of the capacitive unit is configured of a charge circuit of a given current, employing a power supply of a higher voltage than the fully charged voltage in order to charge the capacitive unit within the time predetermined for the purpose, as well as a chopper control in order to achieve highly efficient conversion.

According to this prior art, the 24-volt power supply is routed via a switching unit 1004 and a choke coil 1003 to the capacitive unit 1002. The voltage of the charging current is converted in a current detection resistor 1007, compares the charging current voltage with a baseline power supply 1009 in a comparator 1008, and pulses at a gate of a one-shot multivibrator 1006. The one-shot pulse switches off the switching unit 1004, and transmits the current, with which the choke coil 1003 is charged by a circulating diode 1005 connected to a ground, to the capacitive unit 1002. The chopping circuit of a given current that is switched off for a given time is thus configured into the charging unit.

A hysteresis converter 1010 uses a baseline power supply 1011 to detect the voltage of the electric double layer capacitor, in order to avoid excess charging. The charged power monitoring unit is configured such that, when the detected voltage reaches five volts, a set terminal of the one-shot multi-vibrator 1006 is switched on, forcibly stopping the charge. Reference numeral 1012 is an OR gate, which inputs a forcible charge stop signal from the image process controller 908 into the set terminal of the one-shot multi-vibrator 1006.

FIG. 14 is a diagram describing power storage control at the time of printing, as pertains to the prior arts depicted in the configurations in FIGS. 12 and 13.

Reference numeral 1101 is a fixing temperature, reference numeral 1102 is the incoming AC power, reference numeral 1103 is power accumulated in the capacitor, and reference numeral 1104 is power coming into, and discharging from, the capacitor. The indicators display the charge and discharge operation of the capacitive unit for the intermittent printing that can occur during a cold start, along the same temporal axis. Reference numeral 1107 is a first discharge section and reference numeral 1108 is a second discharge section. The capacitor switches to discharge in section when activating the drum motor drives power consumption to a peak, once either of a predetermined time 1105 or 1106 has passed. Approximately 300 watts of electric power is supplied as 24-volt power to a 24-volt load. When the discharge is completed, power accumulated in the capacitor drops below a level for commencing charging 1112, thus causing charging to take place in either a charging section 1109 or 1110 until a maximum capacitance level 1111 is reached.

The level for commencing charging 1112 is set to a first capacitance level that corresponds to a power level that is required of the capacitive unit for warm-up, and the maximum capacitance level 1111 is set to a second capacitance level that corresponds to a maximum capacitance level of the capacitive unit. A monitoring capacitance level of the charged power monitoring unit maintains the capacitance level between the first capacitance level and the second capacitance level.

The charging rate of the charging unit of the power storage unit is set to a first charging rate, which is capable of reaching the first charged power level and is determined based on time period from an end of a first warm-up, of a first intermittent print at cold start, to a start of a second warm-up, together with the amount of the discharge. The charging rate is set to about 30 watts, which is on the order of 10% of the typical discharge rate.

FIG. 15 describes power storage control as pertains to energy saving standby mode in the configuration in FIGS. 12 and 13. Items in FIG. 15 that describe events identical to events in FIG. 14 are designated with identical reference numerals, and descriptions thereof are omitted.

Reference numeral 1201 is an expanded representation of the charging of the power coming into, and discharging from, the power storage unit. Reference numeral 1203 is section of the energy saving standby mode, in which the energy saving unit suspends power to the actuator and so on at an energy saving command generation timing 1202. The configuration is intended to reduce power consumption only with the idle state power of the 5-volt DC power supply for control insulated-type DC/DC converter 906 of the two-converter low-voltage power supply 903, and the sleep power and the capacitive unit's charging power of the image process controller 908 and the image forming controller 909.

Even though power is being conserved in energy saving standby mode by powering off at predetermined loads according to the above prior arts, a charging power consumption 1207 of approximately 30 watts occurs during charging of the capacitive unit in a first charge section 1204 of the energy saving standby mode. A power consumption similar to the charging power consumption 1207 occurs even in a second charge section 1206 of the energy saving standby mode, which is a recharge operation resulting from a natural discharge of the capacitive unit. The charging power consumption in the first or second charge section is in the range of 35 watts, as compared with a normal power consumption in the range of 5 watts in a non-charge section 1205 of the energy saving standby mode, and thereby a spike arises in power consumption.

While this power consumption is small as average power consumption because of the short duration, the amount of power involved may exceed energy saving standards. It is therefore necessary as a countermeasure to stop charging during the energy saving standby mode.

Stopping recharging during the energy saving standby mode, however, causes both a natural discharge of the capacitive unit and a cool down of the fixing unit being left unattended. Consequently, either the capacitive unit is recharged or the fixing unit is warmed up without any assistance from the capacitive unit, when recovering from the energy saving standby mode to the ready mode. In either case, more time is required to recover the image forming apparatus to a print-ready mode, and thereby resulting in a loss of the on demand capability thereof.

In particular, when setting a time period short before switching to the energy saving mode, the frequency increases with which the image forming apparatus switches to the energy saving standby mode without the charged level of the capacitive unit being fully recharged. Hence, the method in which the charging of the capacitive unit is stopped in the energy saving standby mode fails to maintain the on demand capability.

SUMMARY OF THE INVENTION

An object of the present invention, to solve the above problems, is to provide an image forming apparatus and a method of controlling a power supply thereof, that are capable of charging while also avoiding to exceed energy saving power standards that may arise as a result of a projective power consumption in the energy saving standby mode.

Another object of the present invention is to provide an image forming apparatus and a method of controlling a power supply thereof that are capable of on demand fixing using power stored in the capacitive unit even when the image forming apparatus recovers from the energy saving standby mode, and avoiding a loss in charged power from a natural discharge of the capacitive unit in the energy saving standby mode.

A further object of the present invention is to provide an image forming apparatus and a method of controlling a power supply thereof that are capable of avoiding the on demand capability being lost as a consequence of recovering from the energy saving standby mode before the charger power level of the capacitive unit has been adequately restored.

To solve the problems, the image forming apparatus of the present invention is provide, which has a thermal fixing unit adapted to fix a transfer image upon a recording medium by electrothermally generated heat, and comprises; a capacitive unit adapted to accumulate electric power at a predetermined charging level; an inputted current reducing unit adapted to reduce a current inputted from an external power source using electric power charged in the capacitive unit together with electric power from the external power source, when warming up the thermal fixing unit; a first charging unit adapted to charge the capacitive unit at a first charging rate capable of recharging the capacitive unit within a warming up section; a second charging unit adapted to charge the capacitive unit at a second charging rate that is lower than the first charging rate and greater than a natural power discharge rate of the capacitive unit maintaining a charged level; and a charge switching control unit adapted to switch a power source charging the capacitive unit from the first charging unit to the second charging unit when the image forming apparatus transitions into an energy saving standby mode, and to return the power source charging the capacitive unit from the second charging unit to the first charging unit when the image forming apparatus returns from the energy saving standby mode.

The predetermined charged level includes a charging start level and a maximum charged level, and the image forming apparatus further comprises a charged level control unit adapted to maintain the charged level of the capacitive unit between the charging start level and the maximum charged level by starting charging when the charged level is below the charging start level and stopping charging when the charged level of the capacitive unit reaches the maximum charged level.

The image forming apparatus further comprises: a charged level detection unit adapted to detect the charged level of the capacitive unit in the energy saving standby mode; a discharge rate computation unit adapted to compute a discharge rate of the capacitive unit from a temporal change of the charged level detected; and an inhibit unit adapted to inhibit charging of the capacitive unit and a use of electric power discharged from the capacitive unit, when the computed discharge rate of the capacitive unit is greater than or equal to a predetermined discharge rate.

A method of controlling a power supply of an image forming apparatus having a thermal fixing unit adapted to fix a transfer image upon a recording medium by electrothermally generated heat, is also provided. The method comprises: an inputted current reducing step of reducing a current inputted from an external power source using electric power charged in a capacitive unit adapted to accumulate electric power at a predetermined charging level together with electric power from the external power source, when warming up the thermal fixing unit; a first charging step of charging the capacitive unit at a first charging rate capable of recharging the capacitive unit within a warming up section; a second charging step of charging the capacitive unit at a second charging rate that is lower than the first charging rate and greater than a natural power discharge rate of the capacitive unit maintaining the charged level; and a charge switching control step of switching a charging step of charging the capacitive unit from the first charging step to the second charging step when the image forming apparatus transitions into an energy saving standby mode, and returning the charging step of charging the capacitive unit from the second charging step to the first charging step when the image forming apparatus returns from the energy saving standby mode.

The present invention adds a second charging unit to a conventional first charging unit, and switches over to charging via the second charging unit in energy saving standby mode. As a result, the present invention charges while avoiding exceeding energy saving standards as a consequence of a projective power consumption in the energy saving standby mode. The present invention has an additional benefit of avoiding a loss in charged power from a natural discharge of the capacitive unit in the energy saving standby mode, and facilitating on demand fixing using power stored in the capacitive unit even when the image forming apparatus recovers from the energy saving standby mode.

With regard to the timing of transitioning to the energy saving standby mode, no transition is made to an energy saving state of a power consumption unit if the first charging unit is in a charge status, and the transition is made to the energy saving state and a switch is made to charging via the second charging unit, at such time as when the charged power level reaches a predetermined power level. It is thus possible to avoid a problem of losing the on demand capability as a consequence of recovering from the energy saving standby mode before the charged power level of the capacitive unit has been adequately restored.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 4 is a conceptual configuration diagram describing a hardware configuration of a power supply control of an image forming apparatus according to a second embodiment.

DESCRIPTION OF THE EMBODIMENTS

Following is a description of preferred embodiments of the present invention, with reference to the attached drawings.

First Embodiment

A first embodiment of the present invention is configured to add a second charging unit to a conventional first charging unit, and to switch over to charging via the second charging unit in energy saving standby mode, by way of providing a unit that reduces power consumption when charging a capacitive unit in energy saving standby mode. In the energy saving standby mode, a backlight in a display panel is dimmed, a power supply for running the display is switched off, a power supply to a paper feed or a paper discharge optional unit is switched off, a power supply for control of such aspects as lighting of a photo interrupter is switched off, an actuator power supply for such purposes as switching off an idle state current of an actuator, including a scanner motor, a solenoid, a stepping motor, a DC motor, and a cooling fan, is itself turned off, a converter that suspends a switching operation of a switching power supply is itself suspended, and/or a clock speed of a controller logic circuit is decreased.

Figure 1A:
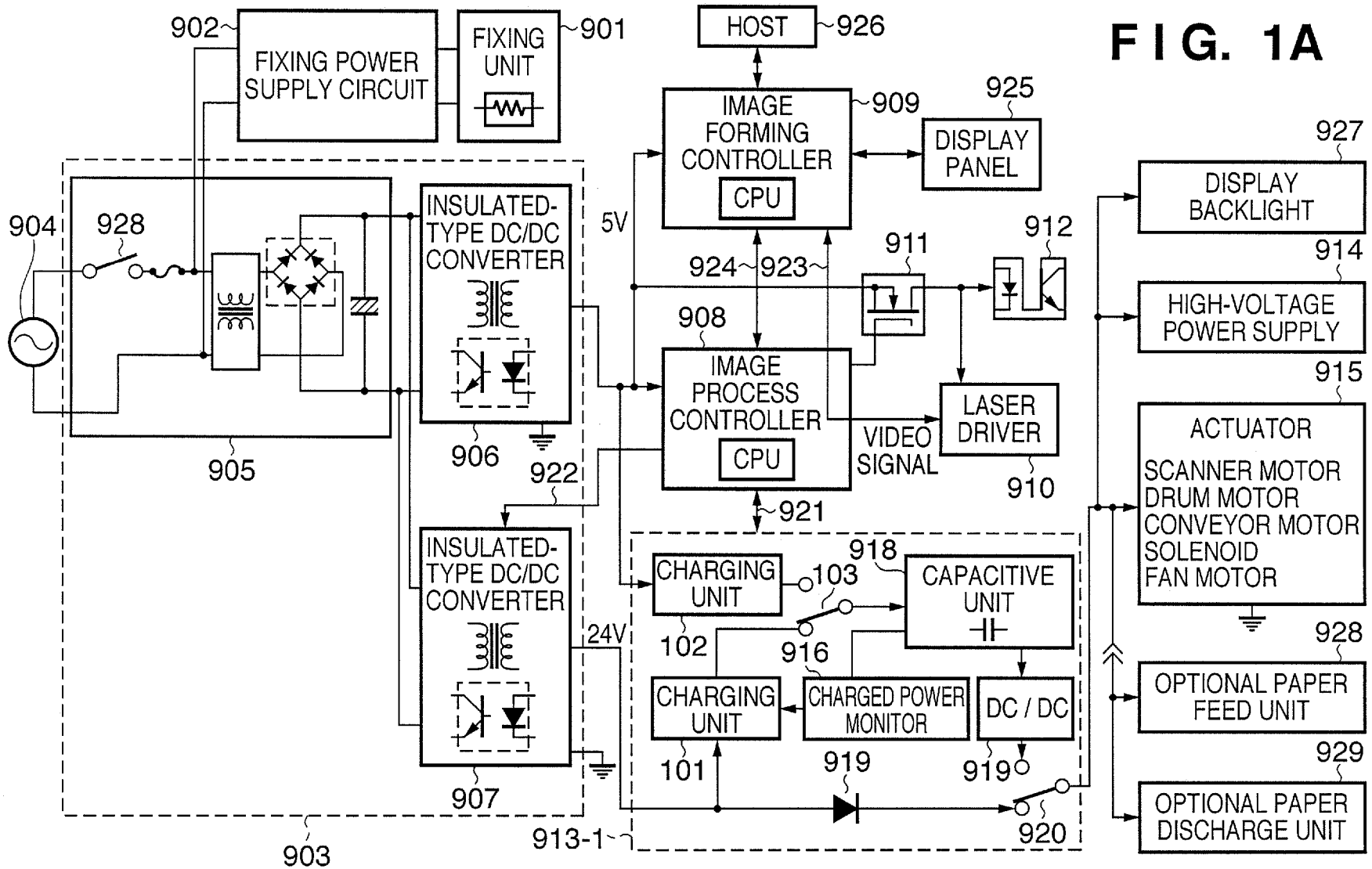
FIG. 1A is a conceptual configuration diagram describing a hardware configuration of a power supply control of an image forming apparatus according to a first embodiment.

Example of Configuration of Power Supply Control of Image Forming Apparatus According to First Embodiment FIG. 1A is a conceptual configuration diagram describing a hardware configuration according to the embodiment.

Reference numeral 901 is a fixing unit which fixes a transfer image upon a recording medium with electrothermally generated temperature. The fixing unit 901 is inductively heated by supplying high-frequency electric power, which is generated from an AC power of an AC power supply 904 by a fixing power supply circuit 902, and is controlled to remain its temperature at a predetermined temperature by an image process controller 908.

Reference numeral 903 is a two-converter low-voltage power supply that receives electric power from the AC power supply 904 that is converted into primary DC voltage by a rectification circuit 905, and outputs a 5-volt DC power supply for control and a 24-volt DC power supply for an actuator via separate insulated-type DC/DC converters 906 and 907, respectively.

Reference numeral 908 is the image process controller, which communicates with an image forming controller 909, which is connected to a host 926, via a command signal 924. The image process controller 908 synchronizes, as image forming parts, a laser driver 910, a high-voltage power supply 914, and an actuator 915 with a video signal 923 under a well-known electrophotographic process. The actuator 915 comprises such components as a scanner motor, a drum motor, a conveyor motor, and a solenoid fan motor. The synchronization control uses information of sensors 912. A toner image is formed on a recording medium, and the image is pressed and fixed by the temperature controlled fixing unit 901. Reference numeral 927 is a backlight that illuminates a display panel 925.

Reference numeral 911 is a power saving switch, and reference numeral 922 is a signal to suspend the converter. If the image forming apparatus is not accessed via either the host 926 or the display panel 925 within a set period of time, the image forming controller 909 generates an energy saving command. Upon receipt of the energy saving command, the image process controller 908 performs power saving through interrupts and suspensions, and transitions to energy saving standby mode, with the ready signal in the negative.

Reference numeral 913-1 is a power storage unit according to the embodiment, which is inserted in a supply route of the 24-volt output of the two-converter low-voltage power supply. In the power storage unit 913-1, a charging unit 101, for which the 24-volt power is provided, supplies a constant current to charge a capacitive unit 918, which is constituted of an electric double layer capacitor. The capacitive unit 918 is charged until a predetermined level of charged power is reached under control of a charged power monitoring unit 916. A power storage unit control signal 921 including a stop charging signal, issued by the image process controller 908, stops the charging of the capacitive unit 918 and activates a DC/DC converter 919. A discharge switch 920 switches the power supplied to various loads for image forming from the 24-volt output from the two-converter low-voltage power to a 24-volt output boosted from an output of the capacitive unit 918 by the DC/DC converter 919. The electric power that is charged in the capacitive unit 918 is supplied as low-voltage power in place of the 24-volt output from the two-converter low-voltage power. Therefore, the incoming AC power for the low-voltage power supply is reduced, and the reduced AC power for the low-voltage power supply is allocated to the AC power for the power supply of the fixing unit.

Reference numeral 101 is a first charging unit, in similar to the charging unit 917 in the conventional example, to which the 24-volt power supply is inputted and from which a constant current is used to charge the capacitive unit 918 via a charging switch relay 103. A second charging unit 102 is provided in addition to the first charging unit 101, according to the embodiment. The second charging unit 102 is configured to receive the output of the 5-volt DC control power supply and to charge the capacitive unit 918 with its output via the charging switch relay 103 as a switching unit.

Example of Configuration of Image Process Controller 908

Figure 1B:
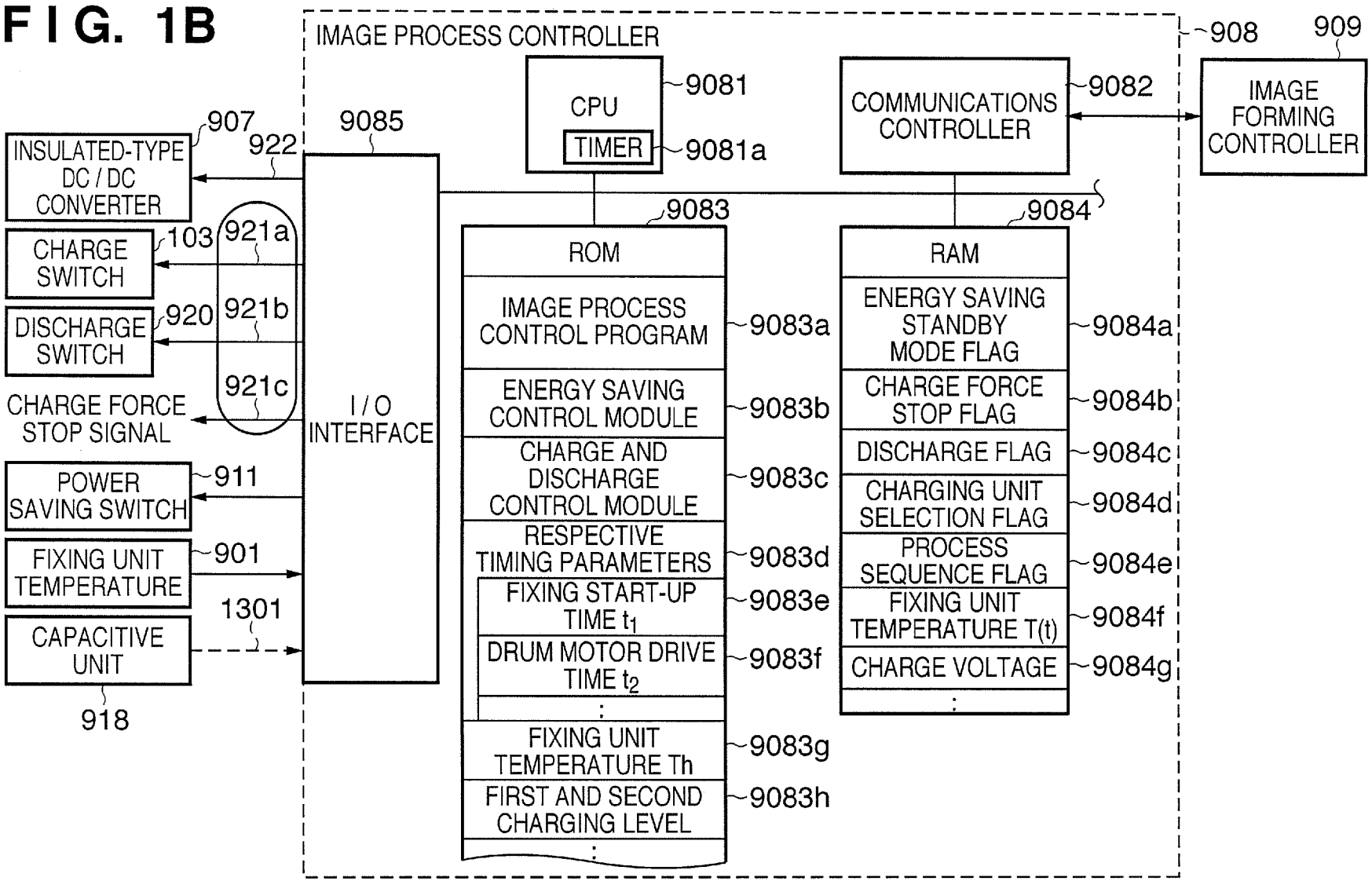
FIG. 1B is a conceptual configuration diagram describing a hardware configuration of an image processing controller according to the embodiment.

FIG. 1B is a block diagram depicting an example of a configuration of the image processing controller 908 depicted in FIG. 1A. While FIG. 1B depicts an example that implements control in software, it would also be possible to implement control via a hardware configuration. It would also be permissible for control to be shared with the image forming controller 909 in FIG. 1A. FIG. 1B depicts a configuration that is closely related to the embodiment, with other elements being omitted.

The image process controller 908 comprises a CPU 9081 for computational control, which controls the image forming process, and a communications controller 9082, which controls communication with the image forming controller 909. The CPU 9081 comprises a timer 9081*a*, which keeps track of time.

The image process controller 908 also comprises a ROM 9083, which stores programs that the CPU 9081 executes and data, and a RAM 9084, which serves as a temporary storage area while the CPU 9081 is in operation.

The ROM 9083 stores an image process control program 9083*a*, which is related to the embodiment, as well as an energy saving control module 9083*b* and a charge and discharge control module 9083*c*, which are embedded within the image process control program 9083*a*. Also stored in the ROM 9083 are such elements as a fixing start-up time (t1) 9083*e* and a drum motor drive time (t2) 9083*f*, as various timing parameters 9083*d*. The ROM 9083 additionally stores a setting temperature (Th) 9083*g* of the fixing unit, as well as a first and second charging levels 9083*h*, which are used in FIG. 8, according to a fourth embodiment.

The RAM 9084 maintains a plurality of flags 9084*a* through 9084*d*, which signify forking during the execution of image process control program 9083*a*. The RAN 9084 also maintains a space for a current process sequence 9084*e*, a current fixing unit temperature (T(t)) 9084*f*, and a current charge voltage 9084*g*, which is used according to the fourth embodiment. The above flags 9084*a* through 9084*d* are a flag 9084*a* that indicates whether or not the energy saving standby mode is set, a flag 9084*b* that indicates to force to stop charging, a discharge flag 9084*c*, and a flag 9084*d* that indicates whether the first charging unit or the second charging unit is used. The flags 9084*a* through 9084*d* correspond to signals that control such elements as the power storage unit 913-1, the insulated-type DC/DC converter 907, and the power saving switch 911.

The RAM 9084 also comprises an I/O interface 9085 that interfaces with output of signals that control respective elements, as well as input of information that denotes statuses of an apparatus.

The energy saving mode signal 922 is outputted via the I/O interface 9085 to the insulated-type DC/DC converter 907, and a charge control signal 921*a* is outputted via the I/O interface 9085 to the charging switch relay 103. A discharge control signal 921*b* is outputted via the I/O interface 9085 to the discharge switch 920, a forcible charge stop signal 921*c* is outputted via the I/O interface 9085 and a power saving control signal is outputted via the I/O interface 9085 to the power saving switch 911. A temperature from the fixing unit 901 is inputted via the I/O interface 9085, and a charging potential level 1301, which is used according to the fourth embodiment, is inputted via the I/O interface 9085 from the capacitive unit 918.

Example of Operation of Image Process Controller 908

Figure 1C:
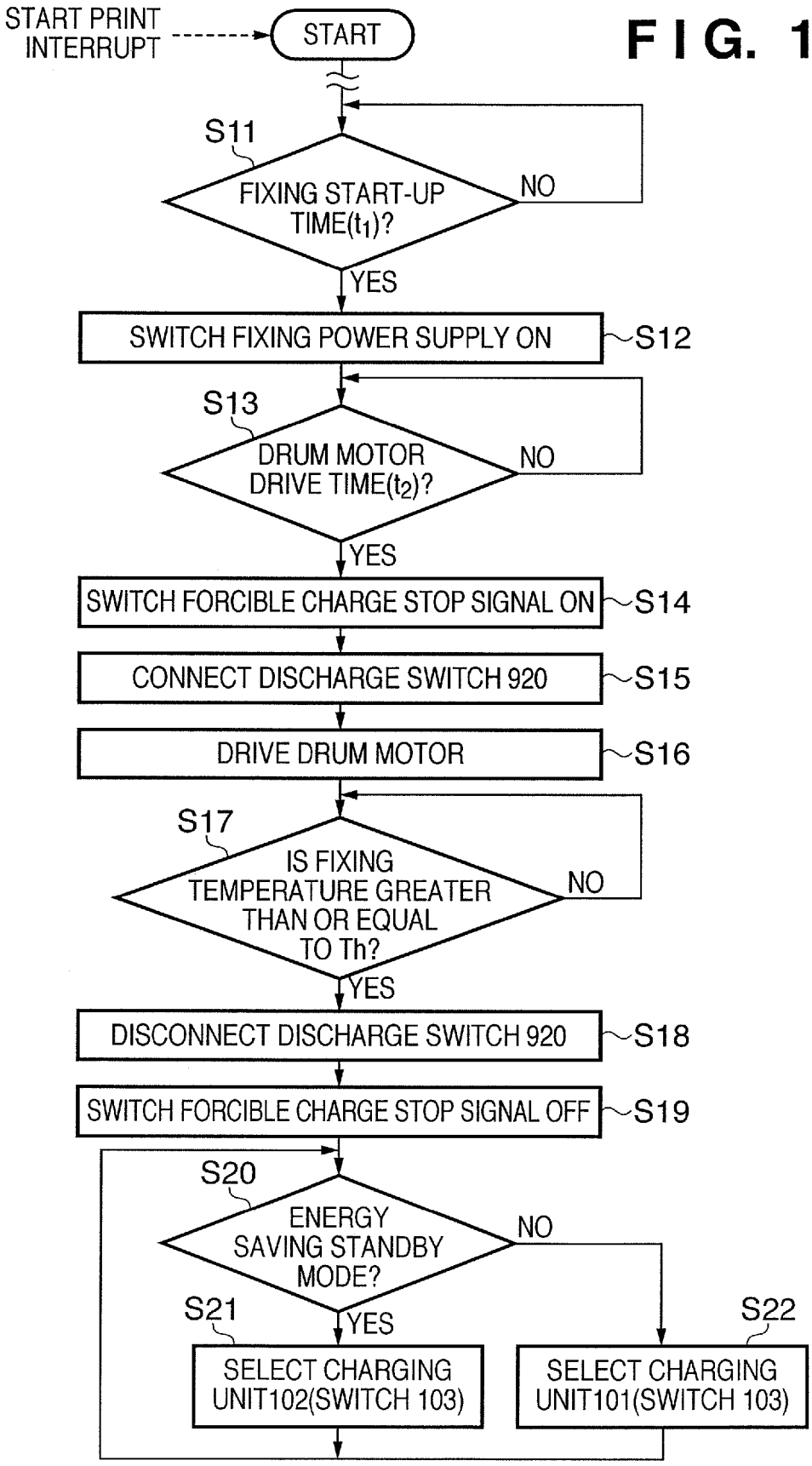
FIG. 1C is a flowchart describing an example of a conceptual process sequence of an image process controller according to the embodiment.

FIG. 1C is a flowchart describing an example of a control sequence of the image process controller 908 depicted in FIG. 1A. The flowchart depicts only an operation that is related to the embodiment, but other elements are omitted. It would be permissible for the flowchart to be contained within a control of another image process, or to be executed in parallel thereto.

The CPU 9081 repeatedly loops through the flowchart in FIG. 1C in response to an interrupt at a start of printing. The flowchart begins with the execution of a predetermined process in accordance with the image process control. Initially, the charging switch relay 103 is connected to the first charging unit 101, and the discharge switch 920 is connected to the insulated-type DC/DC converter 907.

A judgment is made in step S11 as to whether or not the image process control has reached the fixing start-up timing (t1). If having reached the fixing start-up timing (t1), the process proceeds to step S12, in which the fixing power supply is switched on and the fixing unit is heated up.

A judgment is made in step S13 as to whether or not the image process control has reached the drum motor driving start time (t2). If having reached the drum motor driving start time (t2), the process proceeds to step S14, in which the forcible charge stop signal is set to on. In step S15, the discharge switch 920 is connected to the DC/DC converter 919, and the output of the capacitive unit 918 is supplied versus the load after being boosted from 5 to 24 volts. The drum motor is driven in step S16.

A judgment is made in step S17 as to whether or not the fixing temperature has reached the target temperature Th. If having reached the target temperature Th, the process proceeds to step S18, in which the discharge switch 920 is disconnected from the DC/DC converter 919 and then reconnected to the insulated-type DC/DC converter 907. The forcible charge stop signal is switched off in step S19, to automatically start charging in accordance with the charged power monitoring unit 916.

A judgment is made in step S20, in the charging process, as to whether or not the current mode of the image forming apparatus is the energy saving standby mode. If in the energy saving standby mode, the charging switch relay 103 is connected to the second charging unit 102, and charging starts using the 5-volt DC control power supply from the insulated-type DC/DC converter 906. If not in the energy saving standby mode, the charging switch relay 103 is connected to the first charging unit 101, and charging starts using the 24-volt power supply from the insulated-type DC/DC converter 907.

Figure 2:
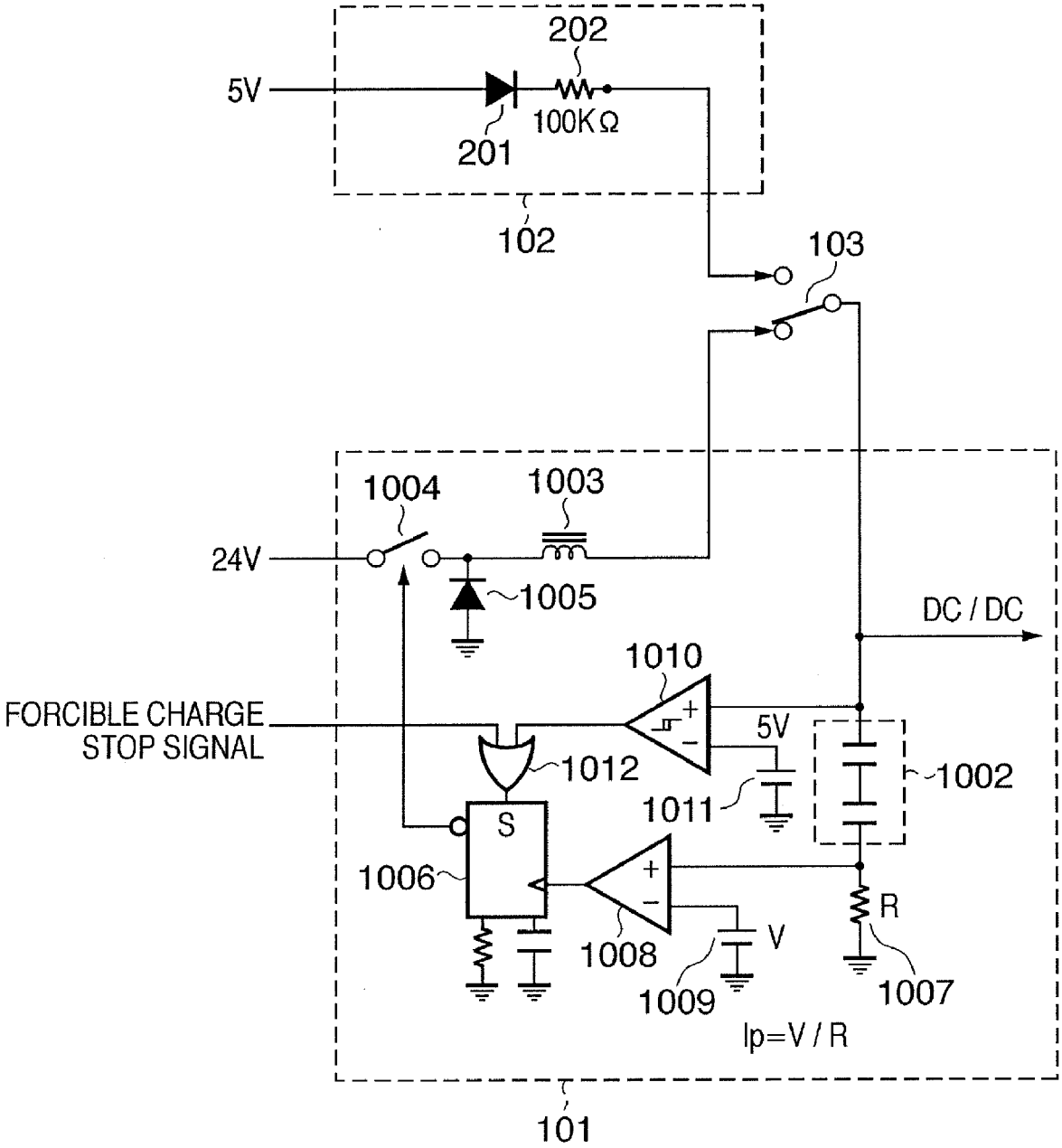
FIG. 2 is a conceptual configuration diagram describing a hardware configuration of a charging component of a power storage unit according to the first embodiment.

Example of Hardware Configuration of Charging Component of Power Storage Unit 913-1 According to First Embodiment FIG. 2 is a conceptual configuration diagram describing a hardware configuration of a charging component of the power storage unit 913-1 depicted in FIG. 1A.

Figure 13:
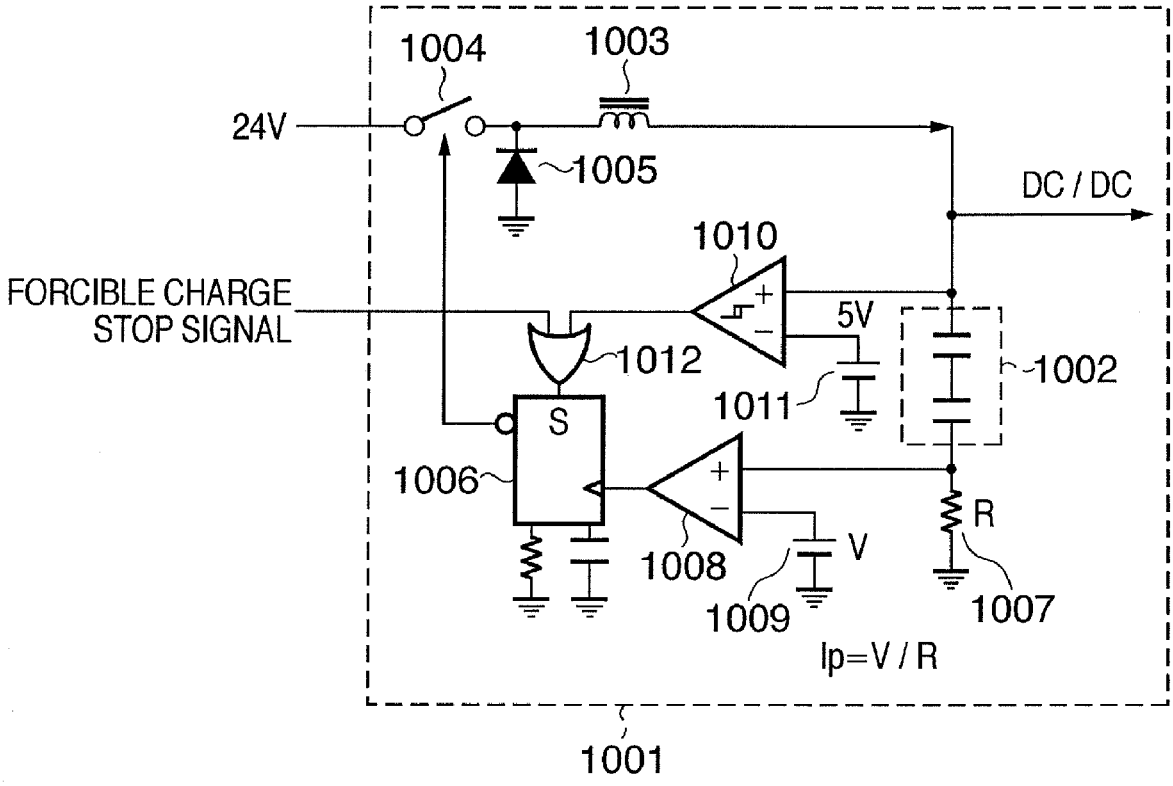
FIG. 13 is a conceptual configuration diagram describing a conventional example of a hardware configuration of a charging component of a power storage unit.
Figure 14:
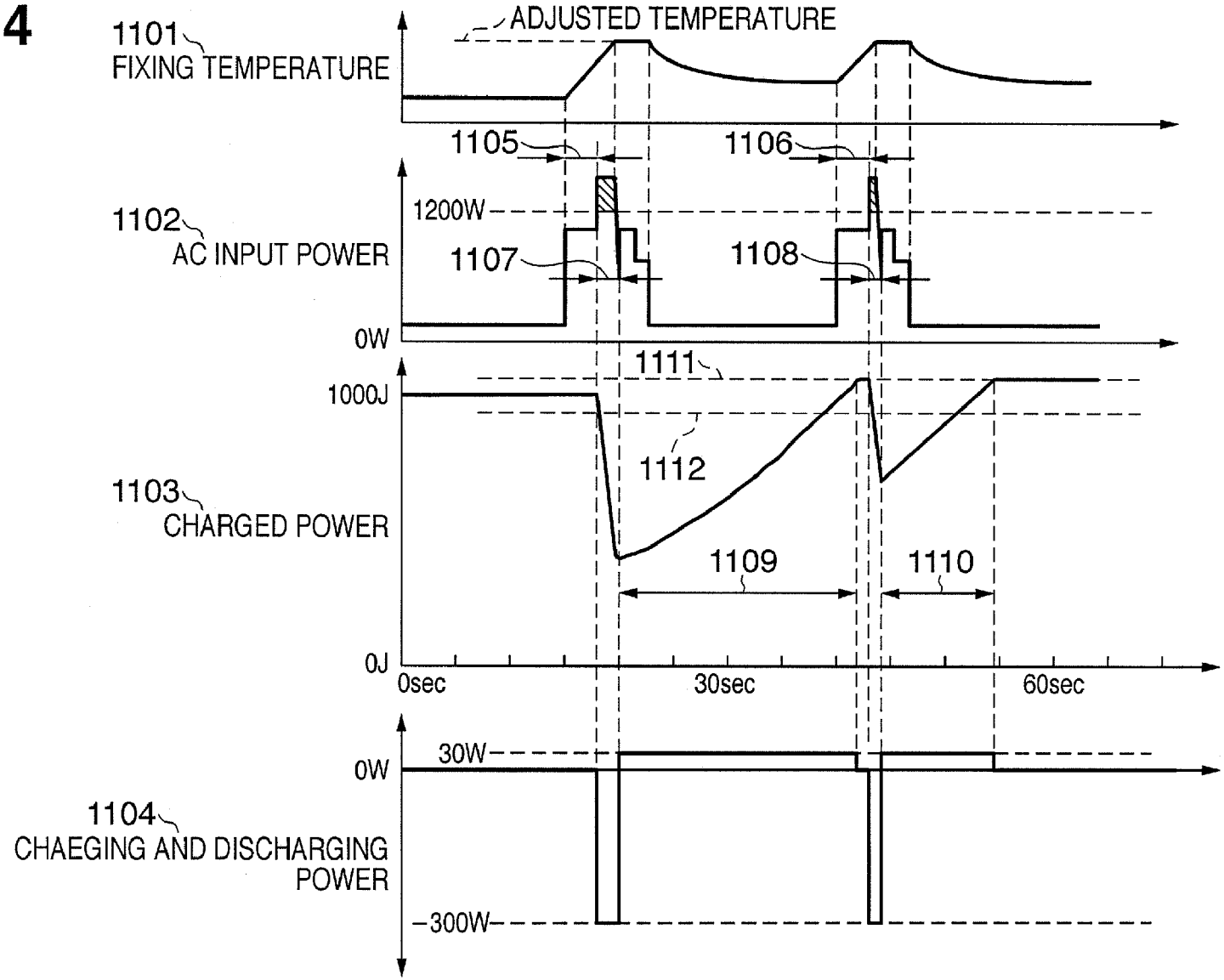
FIG. 14 describes a conventional example of a charging power control at printing.
Figure 15:
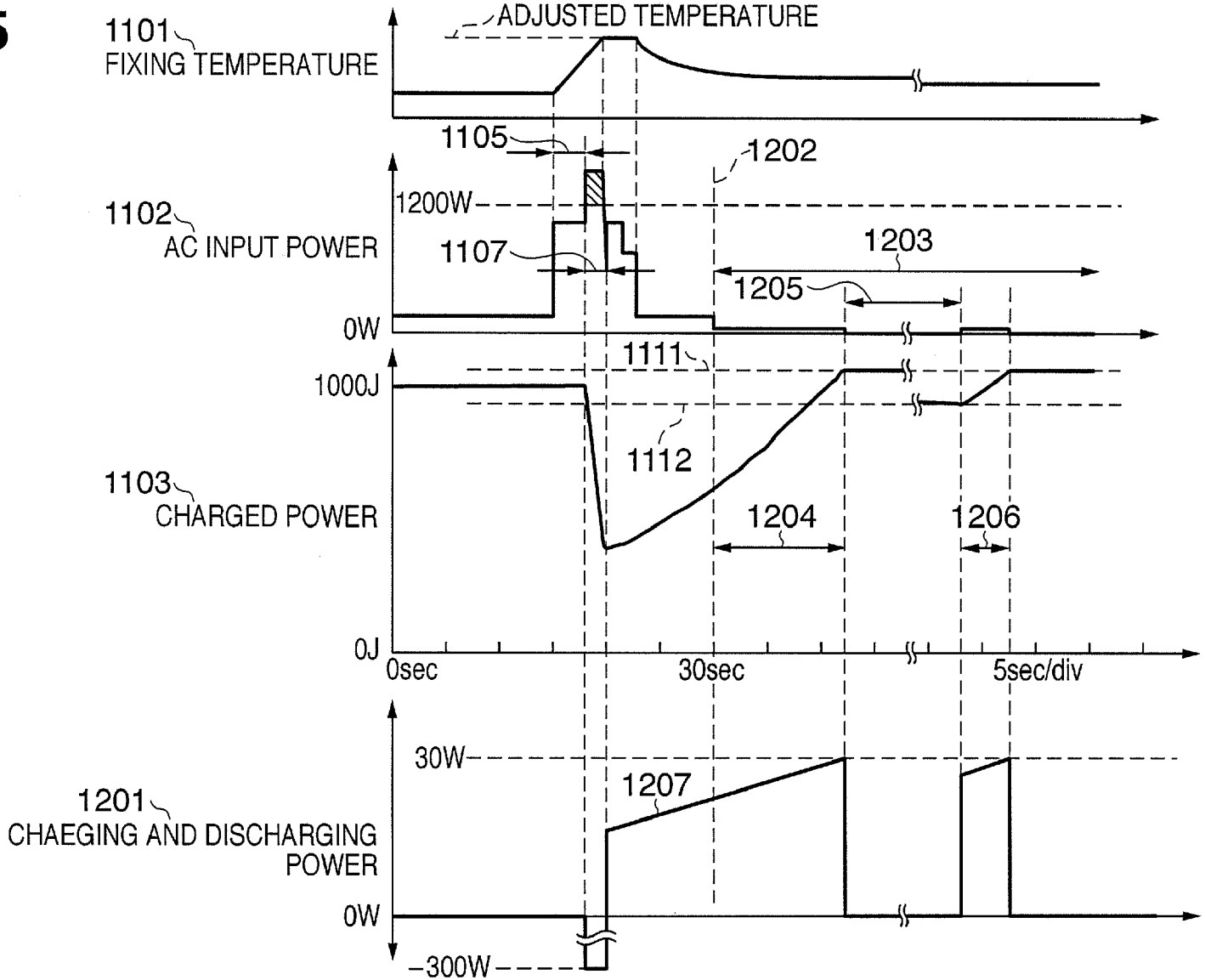
FIG. 15 describes a conventional example of a charging power control in the energy saving standby mode.

Reference numeral 101 is a first charging unit. In order to simplify the description, the first charging unit 101 also includes the capacitive unit 918 and the charged power monitoring unit 916, in addition to the charging unit 101 in FIG. 1A. The first charging unit 101 is identical to the charging component 1001 in the conventional example depicted in FIG. 13, and thus, a description thereof will be avoided herein.

The first charging unit 101 is configured of a chopper constant current circuit that has the same 24-volt power supply as the charging unit 917 in the conventional example, such that it is possible to charge the power storage unit in highly efficient conversion rate within a predetermined time. The second charging unit 102 comprises a backflow blocking diode 201 and a maximum current setting resistor 202, and configures a constant voltage charging circuit with a charge voltage of 5 volts. Although the constant voltage charging circuit may incur such disadvantages as loss of charge due to resistance or speed of charging, it is applied as a charging unit to compensate a natural discharge from the capacitive unit 1002. The charging voltage is made the same 5 volts as the fully charged voltage of the capacitive unit 1002, and then a charging characteristic is set so that the smaller the charge current is the nearer the charging voltage approaches the fully charged voltage. Therefore, it is possible to provide a charging unit that has highly reliable protecting against excess charge and thus incurs no current loss due to switching.

Figure 3:
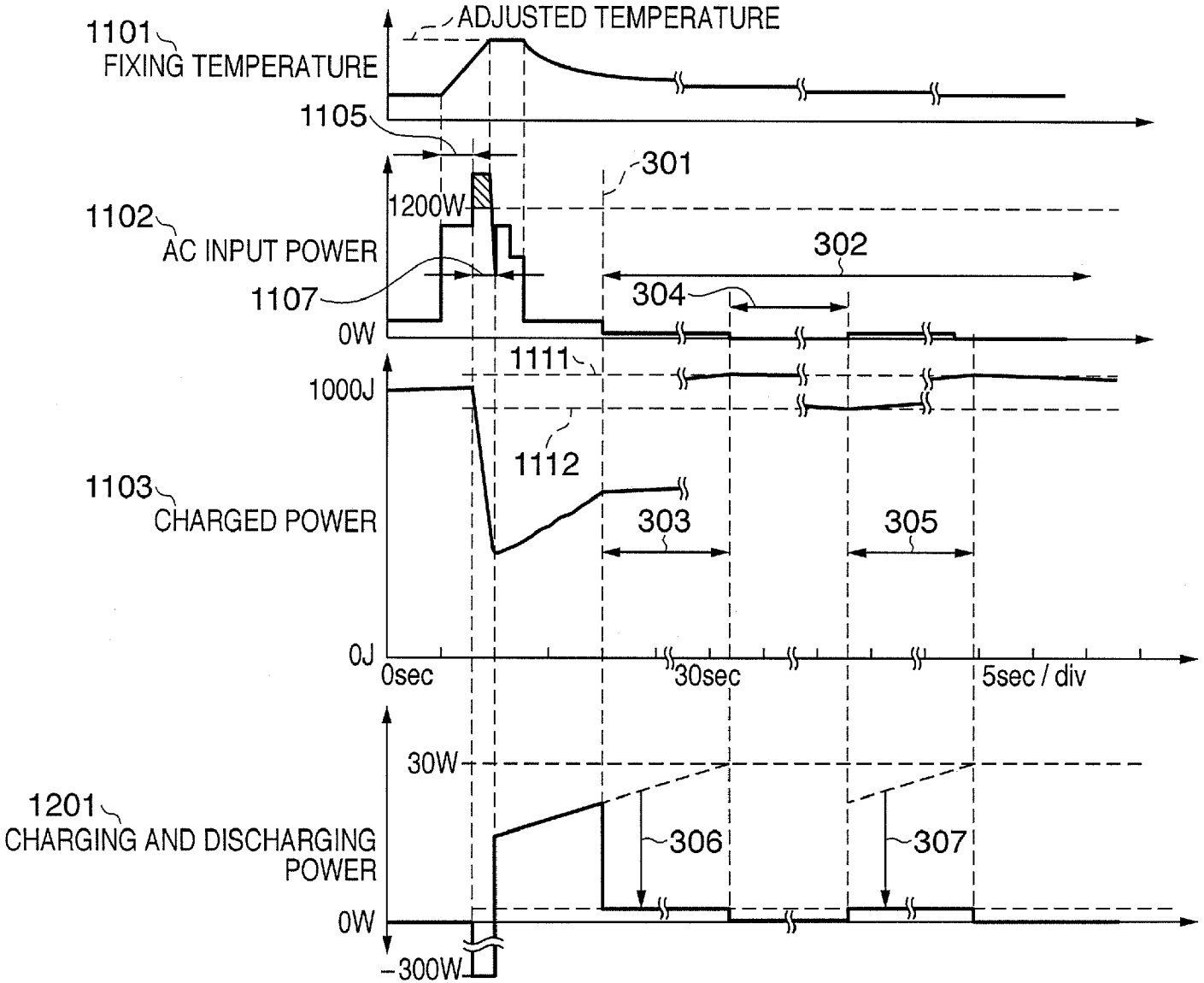
FIG. 3 describes a power storage control in a energy saving standby mode according to the first embodiment.

Example of Operation of Power Supply Control of Image Forming Apparatus According to the First Embodiment FIG. 3 describes a power storage control in a energy saving standby mode in the above mentioned hardware configuration according to the first embodiment.

Reference numeral 1101 is a fixing temperature, reference numeral 1102 is the incoming AC power, reference numeral 1103 is power charged in the capacitive unit, and reference numeral 1201 is power charged into and discharged from the capacitive unit. The charging and discharging power 1201 indicates the charge and discharge operation of the capacitive unit for the intermittent printing occurring in a cold start, along the same time axis. Reference numeral 1107 is a discharge section. The power storage unit switches to discharge during the discharge section 1107, in which power consumption goes to a peak by activating the drum motor after a predetermined time 110 has been elapsed from starting up of the mixing unit. Approximately 300 watts of electric power is supplied as 24-volt power to 24-volt loads. When the discharge is finished, power charged in the capacitive unit drops below a start charging level 1112, and thus charging is performed until a maximum charged level 1111 is reached. The start charging level 1112 is set to a first charged level that corresponds to a power level required for warm-up of the capacitive unit, and the maximum charged level 1111 is set to a second charged level that corresponds to a maximum charged level of the capacitive unit. A monitoring charge level of the charged power monitoring unit maintains the charged level between the first charged level and the second charged level.

The charging power of the charging unit in the power storage unit is set to a first charging rate, which is determined to enable to reach the first charged level based on a time from an end of a first warm-up in a first intermittent print at cold start to a start of a second warm-up and the amount of the discharged power. The charging rate is set to about 30 watts, which is on the order of 10% of the typical discharge rate.

Reference numeral 301 is a timing at which the energy saving command is generated. When the energy saving command is issued by the image forming controller 909 and received by the image process controller 908, the power saving unit is activated, such as the shutting off of power to the actuator, and the status flag 9084*a* of the image process controller 908 is set to the energy saving standby mode. The status is maintained during a section 302 of a energy saving standby mode. When the status flag 9084*a* is set to the energy saving standby mode, the image process controller 908 switches to the charging switch relay 103. As a result, charging power 306 and 307 to the power storage unit are reduced from a constant current charging rate of the first charging unit 101 to a constant voltage charging rate of the second charging unit 102, for a first charging section 303 and a second charging section 305. Therefore, in the energy saving standby mode, recovery to the maximum charged level 1111 and recovery after the charged level has been below the charging start level through natural power discharge from the capacitive unit 1002 maintaining the charged level.

Benefits of the First Embodiment

The controls allow reducing power consumption in the first charging section 303 and the second charging section 305 to a level near a power consumption level that applies during a non-charging section 304, while maintaining a charged level required in the energy saving standby mode.

It is thus possible to maintain the on demand capability within the energy saving standby mode. It is also possible thereby to reduce the power consumption in the standby mode to a sum of the idle power of the insulated-type DC/DC converter 906, the sleep power of the image process controller 908 and the image forming controller 909, and the charging power in the constant voltage charging power rate for the capacitive unit.

Second Embodiment

With regard to a second embodiment, the second charging unit, which reduces power consumption for charging during the energy saving standby mode, is configured by a constant voltage charging circuit to which an AC impedance unit is applied under a chopper control. The second embodiment is characterized by removing a fall in efficiency caused by a current limit resistance, which is a weakness of the constant voltage charge, by switching the charging voltage to change the charging rate of the first charging unit, and thus providing the charging characteristic that is an advantage of the constant voltage charge in a simple configuration.

Example of Configuration of Power Supply Control of Image Forming Apparatus According to Second Embodiment FIG. 4 is a conceptual configuration diagram describing a hardware configuration according to the second embodiment. Configurations according to the second embodiment comprising functions identical to configurations according to the first embodiment are designated with identical reference numerals, and descriptions thereof are omitted. Whereas an example of the present invention using a two-converter low-voltage power supply is described according to the first embodiment, an example using a single converter low-voltage power supply according to the second embodiment will be described.

Reference numeral 405 is a single converter low-voltage power supply, which outputs a 24-volt DC via an insulated-type DC/DC converter 403. Reference numeral 404 is a non-insulated-type DC/DC converter, which converts the 24-volt DC into a 5-volt control DC. It is possible to configure the single converter low-voltage power supply less expensively than the two-converter low-voltage power supply because the non-insulated-type DC/DC converter is configured less expensively and more efficiently than the insulated-type DC/DC converter.

Reference numeral 406 is a field effect transistor (FET) energy saving switch. It is not possible in the single converter low-voltage power supply to stop an operation of the insulated-type DC/DC converter 403 and cut off the 24-volt output, as would be possible with the two-converter low-voltage power supply. Because the single converter low-voltage power supply makes the 5-volt control DC from the 24-volt DC. Consequently, in the energy saving standby mode, the FET energy saving switch is cut off and thereby the 24-volt DC output for the actuator load is switched off.

Reference numeral 913-2 is a power storage unit according to the embodiment, which is inserted into a route of supplying the 24-volt DC output and the 5-volt DC output from the single converter low-voltage power supply. The charging unit 401 performs constant current charging to the capacitive unit 918, which is formed from the electric double layer capacitor, using the 24-volt DC and the 5-volt DC as the power source. Electric power is thus charged under control of a charged power monitoring unit 916 until a predetermined charged level is reached. The power storage unit control signal 921, issued by the image process controller 908, activates the DC/DC converter 919. A discharge switch 920 switches the output power of the power storage unit from the low-voltage 24-volt output to a 24-volt output boosted from the voltage of the capacitive unit 918, and the electric power charged in the capacitive unit 918 is supplied as low-voltage power to the loads in place of the power of the low-voltage power supply. Thus, the incoming AC power to the low-voltage power supply is reduced, and thereby a larger amount of power in the AC power supply 904 can be allocated to the fixing power supply.

Reference numeral 401 is the charging unit, which receives power from the 24-volt power supply and the 5-volt power supply and uses the constant voltage output thereof to charge the capacitive unit 918 at a constant voltage.

Figure 5:
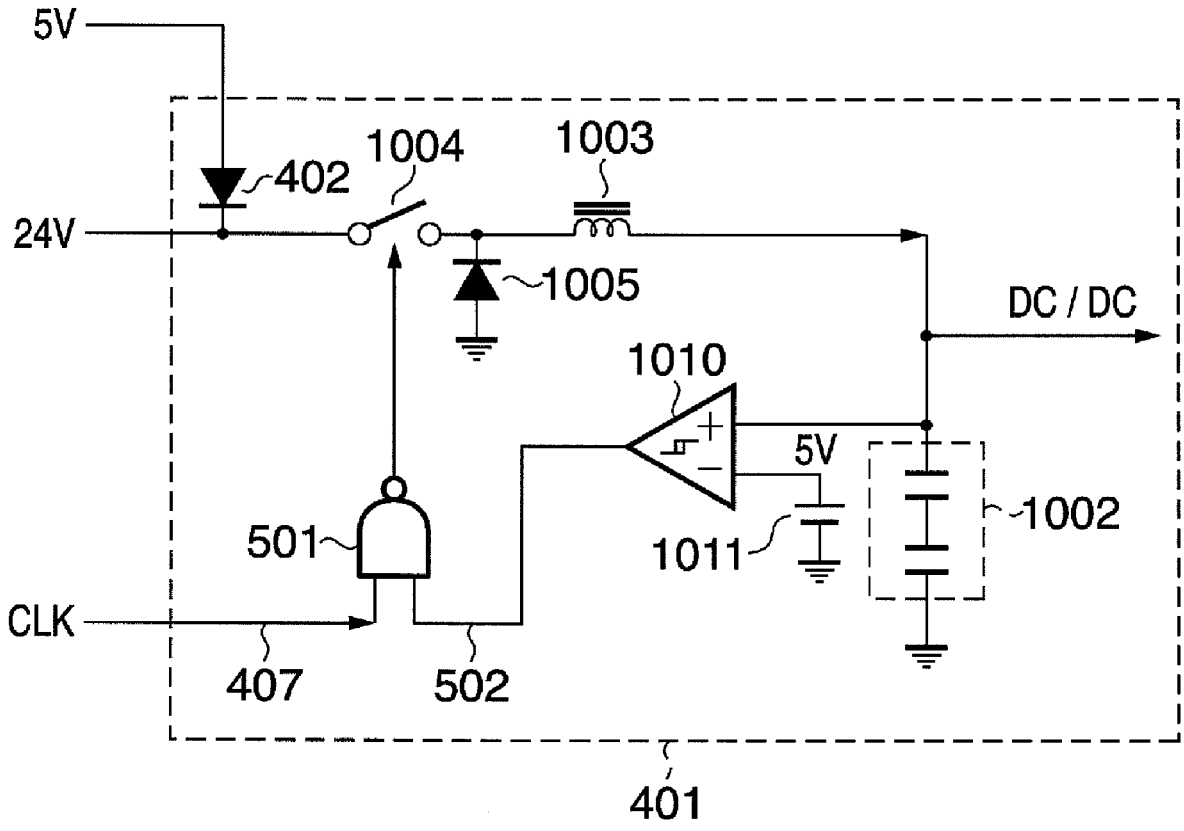
FIG. 5 is a conceptual configuration diagram describing a hardware configuration of a charging component of a power storage unit according to the second embodiment.

Example of Hardware Configuration of Charging Component of Power storage unit 913-2 According to Second Embodiment FIG. 5 is a conceptual configuration diagram describing a hardware configuration of a charging component of the power storage unit 913-2 depicted in FIG. 4. Configurations depicted in FIG. 5 comprising functions identical to configurations depicted in FIG. 4 are designated with identical reference numerals, and descriptions thereof are omitted.

Reference numeral 401 is the charging unit, in which the charging voltage is switched in line with the on/off state of the 24-volt output for the actuator load by way of a charging rate switch diode 402. In the charging unit 401, the charging rate is switched by switching the charging voltage in the constant voltage charging. Thus, the switching of the charging voltage implements a function of switching between the first charging unit and the second charging unit.

The charging unit 401 according to the second embodiment, which includes the first charging unit and the second charging unit, is not the same as the chopper constant current circuit according to the conventional example or the first embodiment. That is, a clock signal 407 is issued from the image process controller 908 and received by a gate circuit 501 comprising a NAND gate, and the switching unit 1004 is switched by a fixed duty ratio, rather than controlling the duty ratio by which the switching unit 1004 is switched on. The gate circuit 501 gates the clock signal 407 by an electric power stop signal 502 when the hysteresis converter 1010 detects a predetermined charged voltage, and thereby the switching unit 1004 is turned off.

Benefits of the Second Embodiment

Given the present configuration, a voltage differential between the charging voltage and the charged voltage of the capacitive unit 1002 is applied to the both ends of the choke coil 1003 by the fixed duty ratio. The AC impedance unit is configured such that the charging current is changed since the choke coil 1003 is charged currently in accordance with the voltage differential. The combination of the AC impedance unit by way of the switching operation and the power supply is the constant voltage charge circuit. Thus, the second embodiment removes a fall in efficiency caused by a current limit resistance, which is a weakness of the constant voltage charge, by switching the charging voltage to change the charging rate of the first charging unit, and thus provides the charging characteristic that is an advantage of the constant voltage charge in a simple configuration. Accordingly, a constant voltage charge operation, which could not be applied for efficiency reasons because of a conventional large charging current, can be applied to the first charging unit. The second charging unit is configured by a parameter switching unit that decreases the charging rate by switching the charging voltage to 5 volts in the energy saving standby mode, and thereby the power consumption in the standby mode can be reduced.

A unique benefit according to the second embodiment is to avoid a problem arises when charging the capacitive unit comprising the capacitors in the constant current charging method, due to applying the constant current charging method to the first charging unit that is the charging unit not in the energy saving standby mode. The problem that the charging speed in the initial charging falls because the charging power changes proportionally to the charged voltage can be avoided, therefore, the second embodiment has the effect of allowing widespread use of the charged range of the electric double layer capacitor.

Third Embodiment

According to a third embodiment, the second charging unit as the charge power consumption reduction unit in the energy saving standby mode is configured as the constant voltage charge circuit using an external power source such as the commercial power source as the power supply. Thus, the third embodiment allows charging when the switching power supply is off as well as in the energy saving standby mode.

Figure 6:
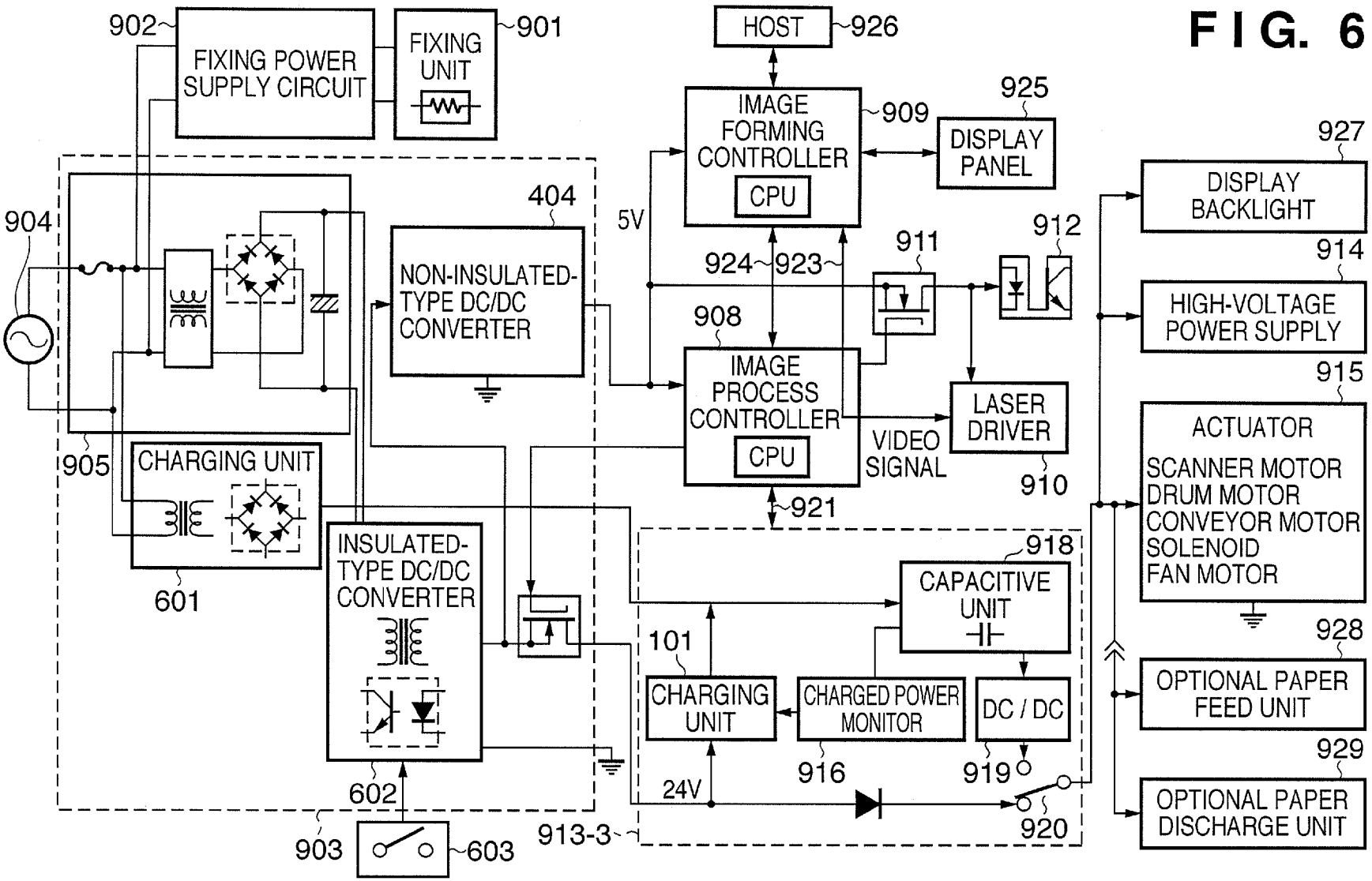
FIG. 6 is a conceptual configuration diagram describing a hardware configuration of a power supply control of an image forming apparatus according to a third embodiment.

Example of Hardware Configuration of Power Supply Control of Image Forming Apparatus According to the Third Embodiment FIG. 6 is a conceptual configuration diagram describing a hardware configuration according to the third embodiment. Configurations depicted in FIG. 6 comprising functions identical to configurations depicted in FIG. 1, according to the first embodiment, and FIG. 4, according to the second embodiment, are designated with identical reference numerals, and descriptions thereof are omitted.

A power source switch 928 as an on/off unit of the low-voltage power source directly opens and closes a primary current route from the commercial power source according to the first and second embodiment. According to the third embodiment, an example of applying a power supply remote switch 603 to the low-voltage power source will be described.

Reference numeral 603 is a power supply remote switch. Rather than directly cutting off the primary current route of the commercial power source, power control is instead assigned to the image process controller by a detection signal of the power supply remote switch 603. A separating operation of the fixing unit and a power down sequence such as the cooling sequence by the fan are then carried out. By stopping a switching operation of an inverter in an insulated-type DC/DC converter 602 and preventing transmission of electric power to a secondary side of an insulated transformer, thereafter the power supply is stopped.

With such a printer, the primary current route of the commercial power source is not cut off even if the power supply remote switch 603 is off.

Reference numeral 601 is the second charging unit, which takes the commercial power source as the power supply thereof and is connected to the capacitive unit 918 of a power storage unit 913-3. It is therefore possible to charge the capacitive unit 918 by the second charging unit 601 when the switching power supply is off as well as in the energy saving standby mode.

Figure 7:
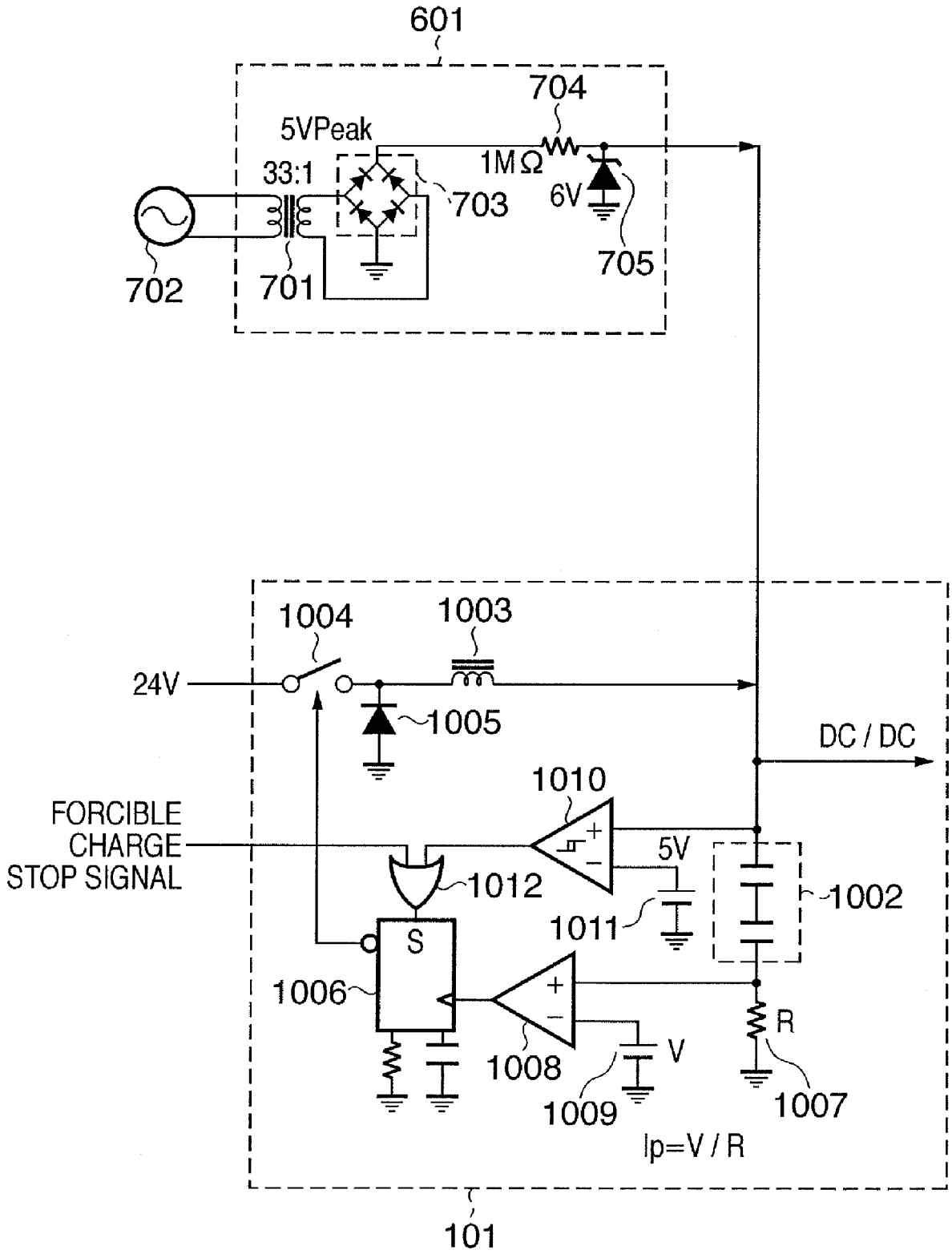
FIG. 7 is a conceptual configuration diagram describing a hardware configuration of a charging component of a power storage unit according to the third embodiment.

Example of Hardware Configuration of Charging Component of Power storage unit 913-3 According to the Third Embodiment FIG. 7 is a conceptual configuration diagram describing a hardware configuration of a charging component of the power storage unit 913-3 depicted in FIG. 6.

Figure 12:
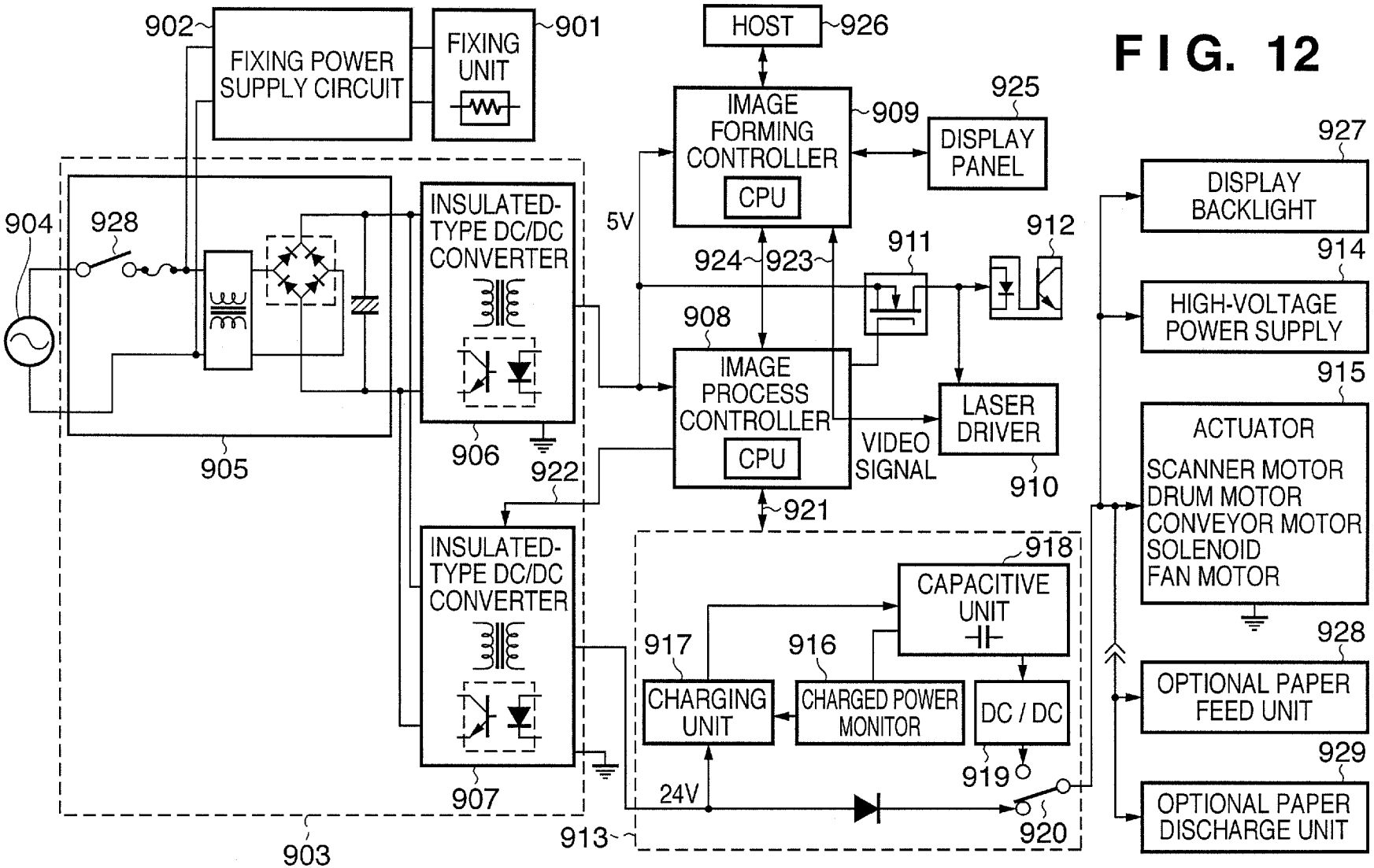
FIG. 12 is a conceptual configuration diagram describing a conventional example of a hardware configuration of a power supply control of an image forming apparatus.

Reference numeral 101 is the first charging unit, and incorporates not only the charging unit 917 in FIG. 1, but also the capacitive unit 918 and the charged power monitoring unit 916, for purposes of simplicity in description. The first charging unit 101 is identical to the charging component 1001 depicted in FIG. 12 of the conventional example, and therefore, a description will be omitted herein.

Reference numeral 601 is the second charging unit, which takes a commercial power source 702 as the power supply thereof and reduces the commercial power voltage 1/33 by way of an insulated transformer 701 serving as an insulated transformer unit. Reference numeral 703 is a bridge diode, which forms an insulated constant voltage charge circuit together with a current limiting resistor 704 and a Zener diode 705 protecting against excessive voltage.

Benefits of the Third Embodiment

Given the third embodiment, in the energy saving standby mode, when stopping the switching of the first charging unit 101 charging by the second charging unit 601 is switched to. It is therefore possible to charge the capacitive unit 918 by the second charging unit when the switching power supply is off as well as in the energy saving standby mode.

A unique benefit according to the third embodiment is that on demand control using the capacitive unit immediately upon switching on the power supply will be allowed by performing an extremely small charging even when the power supply is off.

Fourth Embodiment

According to the first through the third embodiments, the charging start level 1112 and the maximum charged level 1111 are set in a form of hardware in the hysteresis converter 1010. A configuration was described, in which the first and the second charging unit perform charging and discharging control asynchronously to the timing 301 at which the energy saving command is generated. In contrast, a control unit controls switching from the first charging unit to the second charging unit according to the fourth embodiment.

Figure 8:
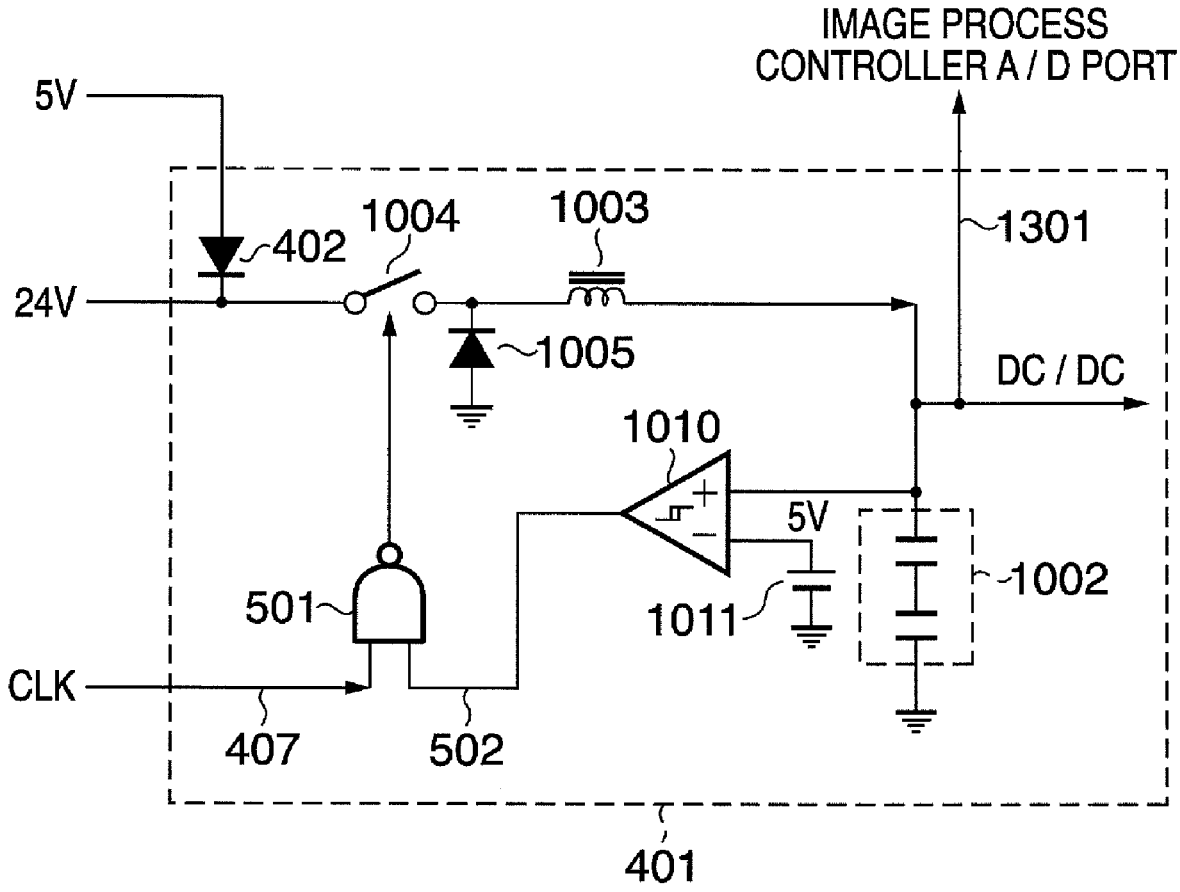
FIG. 8 is a conceptual configuration diagram describing a hardware configuration of a charging component of a power storage unit according to a fourth embodiment.

Example of Hardware Configuration of Charging Component of Capacitor According to the Fourth Embodiment As depicted in FIG. 8, the hardware configuration according to the fourth embodiment extracts the charged voltage of the capacitive unit as depicted in FIG. 5 according to the second embodiment, as the charged potential level 1301, which is in turn inputted into an A/D port of the image process controller 908 and targeted for control by the CPU 9081. The circuit according to the forth embodiment is not limited thereto, however, provided that the configuration is present.

Figure 9:
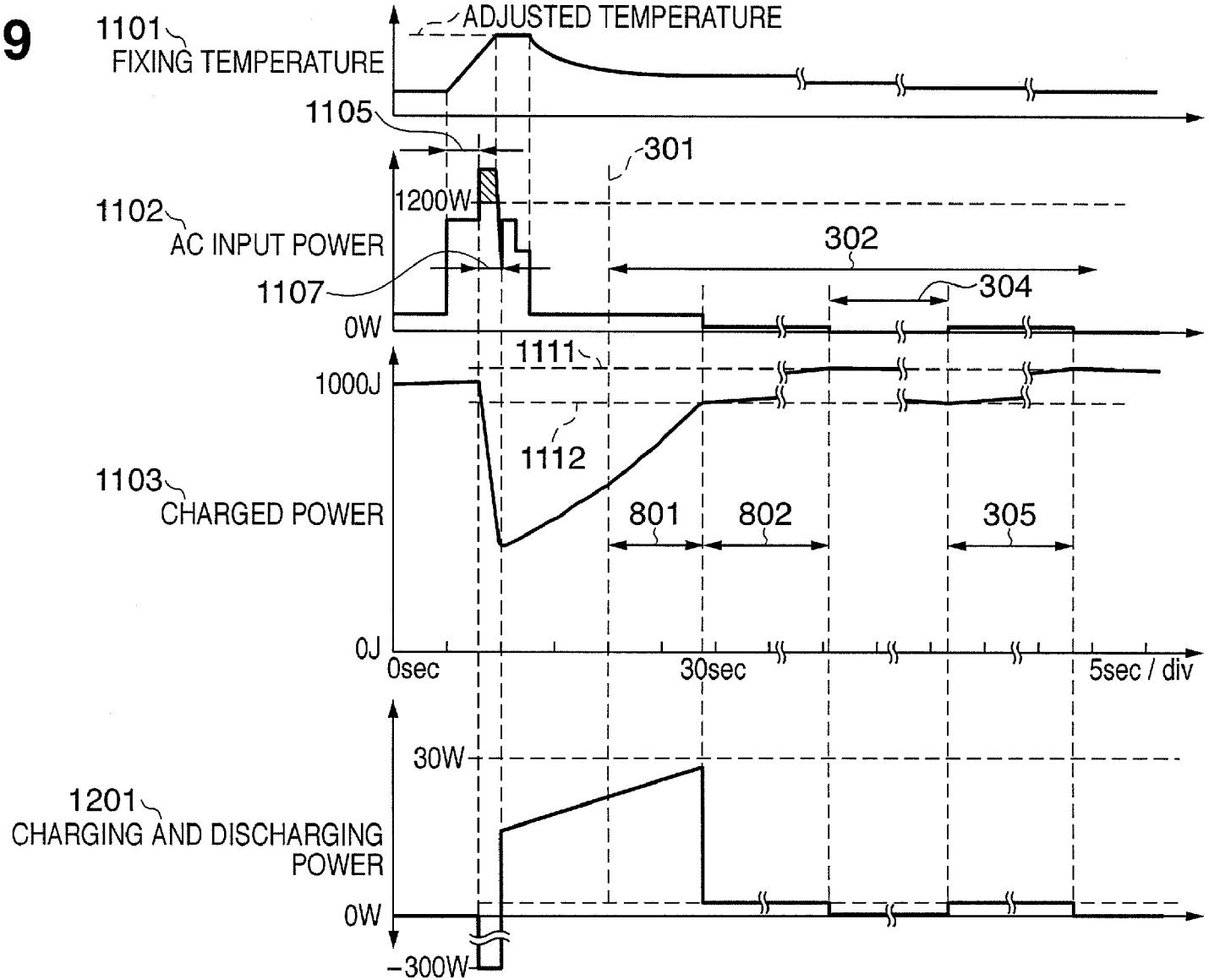
FIG. 9 describes a charging control in a energy saving standby mode according to the fourth embodiment.

Example of Operation of Power Supply Control of Image Forming Apparatus According to the Fourth Embodiment Characteristics according to the fourth embodiment are detecting the charged level and controlling the switching of the charging in accordance with the result of the detection. Accordingly, following is a description of the operation of changing the charged level and the control thereof, which are described in a control description diagram in FIG. 9.

The image process controller 908 suspends transitioning to an energy saving state of a power consumption unit if the charged level by the first charging unit is less than or equal to the charging start level 1112 on the timing 301 at which the energy saving command is inputted by the image forming controller 909. During a section 801 while the transition to the energy saving standby mode is suspended, charging by the first charging unit continues until the charged level has reached the charging start level 1112. When the charged level has reached the charging start level 1112, the transition to the power saving status is performed, a energy saving standby mode flag is stored in a storage unit, and a charging is performed by the second charging unit during a section 802.

The suspension of transitioning to an energy saving state of the power consumption unit is performed by a timing control of cut-off of the FET energy saving switch 406 in FIG. 4 at the power storage unit 401 as shown in FIG. 8. For example, it may be performed by judging an output from the capacitive unit 1002 of the power storage unit 913-1 in FIG. 1 by the image process control unit 908 and then controlling a switching timing of the charging switch relay 103.

The charging start level 1112 is set to the first charging level, which is the quantity of electric power required for the warm-up. The unit that controls the transition to the energy saving standby mode is thus installed in order to ensure that the charge level on the transition to the energy saving standby mode has been greater than or equal to the quantity of electric power required for the warm-up.

Such action by way of the unit controlling the transition to the energy saving standby mode ensures on demand mixing control on waking up from the energy saving standby mode, regardless of whenever the energy saving command is inputted.

Other Embodiments

The preceding embodiments are some of possible examples. It would also be permissible to have a configuration that adds the second charging unit having the different charging rate to the first charging unit capable of recharging within the warm-up section, and that switches to the second charging unit in response to the status flag of the energy saving standby mode.

Figure 10:
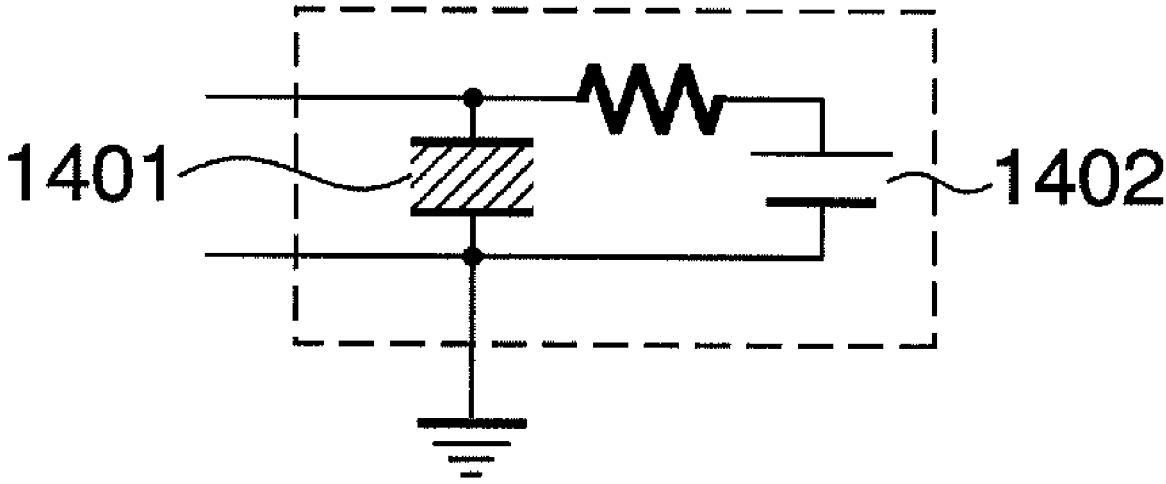
FIG. 10 is a circuit diagram describing an example of a configuration of a capacitive unit according to another embodiment.
Figure 11:
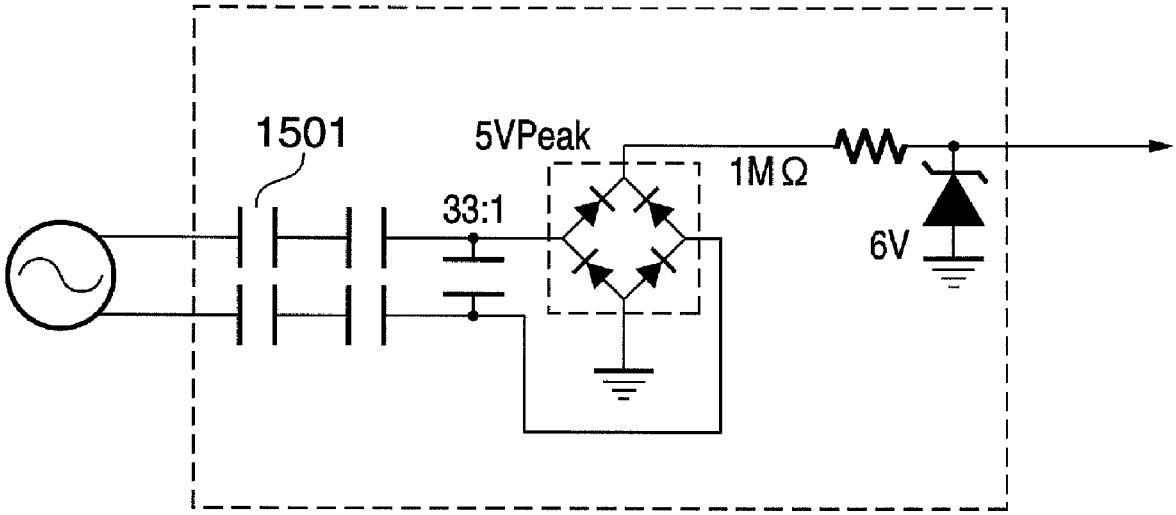
FIG. 11 is a circuit diagram describing an example of a configuration of a second charging unit according to another embodiment.

For example, in place of the electric double layer capacitor, as depicted in FIG. 10, it would be permissible to combine a capacitor 1401 such as an electrolytic capacitor with a secondary battery 1402 such as a proton polymer battery or a nickel hydride battery. It would also be permissible for the first charging unit to be a constant power charging unit comprising a current limiter function though admittedly expensive.

While the insulated transformer unit of the second charging unit using the commercial power source as the power supply thereof is used according to the third embodiment, it would be permissible to serially connect three or more ceramic capacitors in safety-standard 1501, and thereby rectify a partial voltage output.

According to the embodiment, it was possible to charge in the energy saving standby mode by way of the second charging unit. Accordingly, a problem with the capacitive unit owing to increase of a current leak can be detected promptly by comparing a charge clock cycle, reference numeral 304 in FIG. 9, in which the discharge rate of the capacitive unit is minimum state with a standard clock cycle, according to the fourth embodiment. Thus, it would be permissible to configure a fault detection and control unit of the capacitive unit that performs a stop of the charging and discharging of the capacitive unit and restriction of the fixing unit warm-up power. That is, the charged level of the capacitive unit in the energy saving standby mode is detected. Next, a discharge rate of the capacitive unit from a temporal change of the charged level detected is computed. The charging of the capacitive unit as well as a use of electric power discharged from the capacitive unit are inhibited, when the discharge rate of the capacitive unit computed is greater than or equal to a predetermined discharge rate.

The present invention thus reduces the charging power consumption of the capacitive unit in the energy saving standby mode, by adding the second charging unit to the first charging unit capable of recharging within the warm-up section and switching from the first charging unit to the second charging unit in response to the status flag of the energy saving standby mode.

The present invention may be applied to a system configured of a plurality of devices, such as a computer, an interface device, a reader, and a printer, for example, as well as an apparatus configured of a single device, such as a multifunction peripheral, a printer, or a fax machine.

It is to be understood that the objectives of the present invention are achieved by using a recording medium or a storage medium that records a software program code that implements the functions of the embodiments. It is to be understood that, in such a circumstance, the objectives of the present invention are achieved by supplying the recording medium to the system or the apparatus, and the computer, or the CPU or the MPU, of the system or the apparatus loads and executes the program code that is stored on the recording medium. In such a circumstance, the program code itself that is thus loaded from the recording medium implements the functions of the embodiments, and the recording medium that records the program configures the present invention.

The functions of the embodiments are implemented by the execution by the computer of the program code thus loaded. An operating system (OS) or other software that runs on the computer performs actual processing, in whole or in part, in accordance with the instructions of the program code. It is to be understood that a circumstance wherein the functions of the embodiments are implemented by the processing thereof is also included.

The program code that is loaded from the recording medium is written to a memory that is a part of an expansion card that is inserted into a computer, or an expansion unit that is connected to a computer. It is to be understood that a circumstance wherein the CPU or other hardware that is a part of the expansion card or the expansion unit performs actual processing, in whole or in part, in accordance with the instructions of the program code, and that the functions of the embodiments are implemented by the processing thereof, is also included.

Also included within the present invention is a form wherein the functions of the embodiments are implemented by having the program data that implements the functions of the embodiments be downloaded onto the apparatus from either a CD-ROM that is placed into the apparatus, or from an external source of supply such as the Internet/World Wide Web.

When applying the present invention to the recording medium, it is desirable that the program code that is stored on the recording medium support the flowcharts described herein.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-261413, filed on Sep. 26, 2006, which is hereby incorporated by reference herein in its entirety.

What is claimed is:

1. An image forming apparatus having a thermal fixing unit adapted to fix a transfer image upon a recording medium by electrothermally generated heat, comprising:

a capacitive unit adapted to accumulate electric power at a predetermined charging level;

an inputted current reducing unit adapted to reduce a current inputted from an external power source using electric power charged in the capacitive unit together with electric power from the external power source when warming up the thermal fixing unit;

a first charging unit adapted to charge the capacitive unit at a first charging rate capable of recharging the capacitive unit within a warming up section;

a second charging unit adapted to charge the capacitive unit at a second charging rate that is lower than the first charging rate and greater than a natural power discharge rate of the capacitive unit maintaining a charged level;

a charge switching control unit adapted to switch a power source charging the capacitive unit from the first charging unit to the second charging unit when the image forming apparatus transitions into an energy saving standby mode, and to return the power source charging the capacitive unit from the second charging unit to the first charging unit when the image forming apparatus returns from the energy saving standby mode, wherein the second charging unit includes a switching unit adapted to switch any one parameter of a constant current value, a constant voltage value, and a constant power value with respect to the first charging unit, and wherein the second charging unit comprises a constant voltage charging unit configured by serially connecting a constant voltage supply and an impedance unit to the capacitive unit.

2. The image forming apparatus according to claim 1, wherein the capacitive unit comprises at least an electric double layer capacitor.

3. The image forming apparatus according to claim 1, wherein the predetermined charged level includes a charging start level and a maximum charged level, and further comprising a charged level control unit adapted to maintain the charged level of the capacitive unit between the charging start level and the maximum charged level by starting charging when the charged level is below the charging start level and stopping charging when the charged level of the capacitive unit reaches the maximum charged level.

4. The image forming apparatus according to claim 1, wherein a voltage of the constant voltage supply is the maximum charged level that is a fully charged voltage of the capacitive unit.

5. The image forming apparatus according to claim 1, wherein the impedance unit comprises an AC impedance unit in which the constant voltage supply, a choke coil, and a switch are serially connected to the capacitive unit, a circulating diode grounded is connected between the choke coil and the switch, and an average current flows in response to a voltage applied to the choke coil by switching the switch at a fixed duty ratio.

6. The image forming apparatus according to claim 1, wherein the second charging unit comprises an insulated transformer unit using the external power source as the power supply thereof.

7. An image forming apparatus having a thermal fixing unit adapted to fix a transfer image upon a recording medium by electrothermally generated heat, comprising:

a capacitive unit adapted to accumulate electric power at a predetermined charging level;

an inputted current reducing unit adapted to reduce a current inputted from an external power source using electric power charged in the capacitive unit together with electric power from the external power source when warming up the thermal fixing unit;

a first charging unit adapted to charge the capacitive unit at a first charging rate capable of recharging the capacitive unit within a warming up section;

a second charging unit adapted to charge the capacitive unit at a second charging rate that is lower than the first charging rate and greater than a natural power discharge rate of the capacitive unit maintaining a charged level; and a charge switching control unit adapted to switch a power source charging the capacitive unit from the first charging unit to the second charging unit when the image forming apparatus transitions into an energy saving standby mode, and to return the power source charging the capacitive unit from the second charging unit to the first charging unit when the image forming apparatus returns from the energy saving standby mode, wherein the predetermined charged level includes a charging start level and a maximum charged level, and further comprising a charged level control unit adapted to maintain the charged level of the capacitive unit between the charging start level and the maximum charged level by starting charging when the charged level is below the charging start level and stopping charging when the charged level of the capacitive unit reaches the maximum charged level, and wherein the charge switching control unit maintains charging by the first charging unit when the charged level of the capacitive unit is below the charging start level on a transition timing into the energy saving standby mode, and switches from charging by the first charging unit to charging by the second charging unit when the charged level reaches the charging start level.

8. The image forming apparatus according to claim 1, further comprising:

a charged level detection unit adapted to detect the charged level of the capacitive unit in the energy saving standby mode;

a discharge rate computation unit adapted to compute a discharge rate of the capacitive unit from a temporal change of the detected charged level; and an inhibit unit adapted to inhibit charging of the capacitive unit and a use of electric power discharged from the capacitive unit when the computed discharge rate of the capacitive unit is greater than or equal to a predetermined discharge rate.

9. The image forming apparatus according to claim 1, wherein in the energy saving standby mode, at least one of the following operations is performed: a backlight in a display panel is dimmed; a power supply for running the display is switched off; a power supply to a paper feed or a paper discharge optional unit is switched off; a power supply for control of such aspects as lighting of a photo interrupter is switched off; an actuator power supply is turned off for switching off an idle state current of an actuator including a scanner motor, a solenoid, a stepping motor, a DC motor and a cooling fan; a convener is suspended for suspending a switching operation of a switching power supply is itself suspended; and a clock speed of a controller logic circuit is decreased.

10. A method of controlling a power supply of an image forming apparatus having a thermal fixing unit adapted to fix a transfer image upon a recording medium by electrothermally generated heat, said method comprising:

an inputted current reducing step of reducing a current inputted from an external power source using electric power charged in a capacitive unit adapted to accumulate electric power at a predetermined charging level together with electric power from the external power source when warming up the thermal fixing unit;

a first charging step of charging the capacitive unit at a first charging rate capable of recharging the capacitive unit within a warming up section;

a second charging step of charging the capacitive unit at a second charging rate that is lower than the first charging rate and greater than a natural power discharge rate of the capacitive unit maintaining the charged level; and a charge switching control step of switching a charging step of charging the capacitive unit from the first charging step to the second charging step when the image forming apparatus transitions into an energy saving standby mode, and returning the charging step of charging the capacitive unit from the second charging step to the first charging step when the image forming apparatus returns from the energy saving standby mode, wherein the predetermined charged level includes a charging start level and a maximum charged level, and further comprising a charged level control step of maintaining the charged level of the capacitive unit between the charging start level and the maximum charged level by starting charging when the charged level is below the charging start level and stopping charging when the charged level of the capacitive unit reaches the maximum charged level, and wherein in the charge switching control step, charging of the first charging step is maintained when the charged level of the capacitive unit is below the charging start level on a transition timing into the energy saving standby mode, and charging of the first charging step is switched to charging of the second charging step when the charged level reaches the charging start level.

11. A method of controlling a power supply of an image forming apparatus having a thermal fixing unit adapted to fix a transfer image upon a recording medium by electrothermally generated heat, said method comprising:

an inputted current reducing step of reducing a current inputted from an external power source using electric power charged in a capacitive unit adapted to accumulate electric power at a predetermined charging level together with electric power from the external power source when warming up the thermal fixing unit:

a first charging step of charging the capacitive unit at a first charging rate capable of recharging the capacitive unit within a warming up section;

a second charging step of charging the capacitive unit at a second charging rate that is lower than the first charging rate and greater than a natural power discharge rate of the capacitive unit maintaining the charged level;

a charge switching control step of switching a charging step of charging the capacitive unit from the first charging step to the second charging step when the image forming apparatus transitions into an energy saving standby mode, and returning the charging step of charging the capacitive unit from the second charging step to the first charging step when the image forming apparatus returns from the energy saving standby mode;

a charged level detection step of detecting the charged level of the capacitive unit in the energy saving standby mode;

a discharge rate computation step of computing a discharge rate of the capacitive unit from a temporal change of the charged level detected; and an inhibit step of inhibiting charging of the capacitive unit and a use of electric power discharged from the capacitive unit, when the computed discharge rate of the capacitive unit is greater than or equal to a predetermined discharge rate.

* * * * *